US008854351B2

(12) United States Patent
Kim et al.

(10) Patent No.: US 8,854,351 B2
(45) Date of Patent: Oct. 7, 2014

(54) ELECTROPHORETIC DISPLAY DEVICE AND METHOD OF DRIVING AN ELECTROPHORETIC DISPLAY DEVICE

(75) Inventors: Do-Yeon Kim, Suwon-si (KR); Sun-Cheol Kwon, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 236 days.

(21) Appl. No.: 13/361,139

(22) Filed: Jan. 30, 2012

(65) Prior Publication Data

US 2012/0200554 A1 Aug. 9, 2012

(30) Foreign Application Priority Data

Feb. 8, 2011 (KR) ..... 10-2011-0010921

(51) Int. Cl.
*G09G 3/34* (2006.01)
*G09G 3/20* (2006.01)

(52) U.S. Cl.
CPC ..... *G09G 3/344* (2013.01); *G09G 3/2018* (2013.01); *G09G 2300/08* (2013.01)
USPC ..... 345/211; 345/107

(58) Field of Classification Search
CPC .. G09G 3/344; G09G 2300/08; G09G 3/2022
See application file for complete search history.

(56) References Cited

U.S. PATENT DOCUMENTS

| | | | | |
|---|---|---|---|---|
| 7,773,069 | B2 * | 8/2010 | Miyasaka et al. | 345/107 |
| 8,279,244 | B2 * | 10/2012 | Miyasaka et al. | 345/690 |
| 2003/0137521 | A1 * | 7/2003 | Zehner et al. | 345/589 |
| 2006/0290650 | A1 * | 12/2006 | Johnson et al. | 345/107 |
| 2007/0002008 | A1 * | 1/2007 | Tam | 345/107 |
| 2007/0132687 | A1 * | 6/2007 | Johnson | 345/89 |
| 2007/0262949 | A1 * | 11/2007 | Zhou et al. | 345/107 |
| 2008/0094315 | A1 * | 4/2008 | Johnson et al. | 345/58 |
| 2008/0231593 | A1 * | 9/2008 | Johnson et al. | 345/107 |
| 2010/0238093 | A1 * | 9/2010 | Lu et al. | 345/77 |
| 2010/0277509 | A1 * | 11/2010 | Lu et al. | 345/690 |

FOREIGN PATENT DOCUMENTS

| | | |
|---|---|---|
| JP | 2006-243364 | 9/2006 |
| JP | 2010-026159 | 2/2010 |
| KR | 1020060106459 | 10/2006 |

* cited by examiner

*Primary Examiner* — Claire X Pappas
*Assistant Examiner* — Richard Hong
(74) *Attorney, Agent, or Firm* — F. Chau & Associates, LLC

(57) ABSTRACT

A method of driving an electrophoretic display device displays an image during an image frame divided into a plurality of sub-frames. Sub-frame periods of the plurality of sub-frames are determined based on a predetermined resolution of the image. The plurality of sub-frames have sub-frame periods that differ from one another. A plurality of unit pixels are initialized by applying a common voltage to a common electrode and by applying a first voltage to a plurality of pixel electrodes. Each pixel electrode corresponds to a respective one of the plurality of unit pixels. Gray levels of the plurality of unit pixels are controlled by selectively applying one of the common voltage and a second voltage to each pixel electrode during each sub-frame.

16 Claims, 19 Drawing Sheets

FIG. 8

| SUB-FRAME | SF1 | SF2 | SF3 | SF4 | SF5 | SF6 | SF7 | SF8 | SF9 | SF10 | SF11 | SF12 | SF13 | SF14 | SF15 |
|---|---|---|---|---|---|---|---|---|---|---|---|---|---|---|---|
| SUB-FRAME FREQ[Hz] | 120 | 118 | 116 | 112 | 106 | 98 | 90 | 80 | 70 | 60 | 52 | 44 | 36 | 28 | 20 |
| SUB-FRAME PERIOD[ms] | 8.3 | 8.5 | 8.6 | 8.9 | 9.4 | 10.2 | 11.1 | 12.5 | 14.3 | 16.7 | 19.2 | 22.7 | 27.8 | 35.7 | 50 |
| TOTAL BIASING TIME[ms] | 8.3 | 16.8 | 25.4 | 34.4 | 43.8 | 54.0 | 65.1 | 77.6 | 91.9 | 108.6 | 127.8 | 150.5 | 178.3 | 214.0 | 264.0 |

FIG. 14

| SUB-FRAME | SFA | SFB | SFC | SFD | SFE | SFF | SFG | SFH | SFI | SFJ | SFK | SFL | SFM | SFN | SFO |
|---|---|---|---|---|---|---|---|---|---|---|---|---|---|---|---|
| SUB-FRAME FREQ[Hz] | 20 | 28 | 36 | 44 | 52 | 60 | 70 | 80 | 90 | 98 | 106 | 112 | 116 | 118 | 120 |
| SUB-FRAME PERIOD[ms] | 50 | 35.7 | 27.8 | 22.7 | 19.2 | 16.7 | 14.3 | 12.5 | 11.1 | 10.2 | 9.4 | 8.9 | 8.6 | 8.5 | 8.3 |

FIG. 17

| SUB-FRAME | SFA | SFB | SFC | SFD | SFE | SFF | SFG | SFH | SFI | SFJ | SFK | SFL | SFM | SFN | SFO |
|---|---|---|---|---|---|---|---|---|---|---|---|---|---|---|---|
| SUB-FRAME FREQ[Hz] | 20 | 28 | 36 | 44 | 52 | 60 | 70 | 80 | 90 | 98 | 106 | 112 | 116 | 118 | 120 |
| SUB-FRAME PERIOD[ms] | 50 | 35.7 | 27.8 | 22.7 | 19.2 | 16.7 | 14.3 | 12.5 | 11.1 | 10.2 | 9.4 | 8.9 | 8.6 | 8.5 | 8.3 |
| TOTAL BIASING TIME[ms] | 50 | 85.7 | 113.5 | 136.2 | 155.4 | 172.1 | 186.4 | 198.9 | 210 | 220.2 | 229.6 | 238.6 | 247.2 | 255.7 | 264.0 |

ELECTROPHORETIC DISPLAY DEVICE AND METHOD OF DRIVING AN ELECTROPHORETIC DISPLAY DEVICE

CROSS-REFERENCE TO RELATED APPLICATION

This application claims priority under 35 USC §119 to Korean Patent Application No. 2011-0010921, filed on Feb. 8, 2011 in the Korean Intellectual Property Office (KIPO), the disclosure of which is incorporated by reference in its entirety herein.

BACKGROUND

1. Technical Field

Exemplary embodiments of the inventive concept relate to an electrophoretic display device, and more particularly to a method of driving an electrophoretic display device.

2. Discussion of Related Art

Various display devices such as liquid crystal display (LCD) devices, plasma display panel (PDP) devices and organic light emitting display (OLED) devices require a backlight assembly to display an image. However, electrophoretic display (EPD) devices do not need a backlight assembly to display an image. The EPD device has a relatively wide viewing angle, high reflectance, is easy to read, and consumes a relatively low amount of power. The EPD device is an information display that forms visible images by rearranging charged pigment particles using an applied electric field. The EPD device includes a plurality of unit pixels each of which has a plurality of conductive particles. The plurality of conductive particles in each unit pixel move depending on an electric field induced on each unit pixel. The EPD device applies the electric field to change positions of the conductive particles in each unit pixel to control a gray level of each unit pixel, thereby displaying an image.

SUMMARY

According to an exemplary embodiment of the inventive concept, a method of driving an electrophoretic display device displays an image during an image frame divided into a plurality of sub-frames. Sub-frame periods of the plurality of sub-frames are determined based on a predetermined resolution of the image. The plurality of sub-frames have sub-frame periods that differ from one another. A plurality of unit pixels included in the electrophoretic display device are initialized by applying a common voltage to a common electrode and by applying a first voltage to a plurality of pixel electrodes. Each pixel electrode corresponds to a respective one of the plurality of unit pixels. Gray levels of the plurality of unit pixels are controlled by selectively applying one of the common voltage and a second voltage to each pixel electrode during each sub-frame.

The plurality of sub-frames may include first through n-th sub-frames, where n is a natural number>=two. A sub-frame period of a k-th sub-frame may be greater than a sub-frame period of a (k−1)-th sub-frame, where k is a natural number>=two and <=n.

A first unit pixel of the plurality of unit pixels may have a darkest gray level when the second voltage is applied to a first pixel electrode corresponding to the first unit pixel during the first sub-frame through the n-th sub-frame. A second unit pixel of the plurality of unit pixels may have a lightest gray level when the common voltage is applied to a second pixel electrode corresponding to the second unit pixel during the first sub-frame through the n-th sub-frame.

A third unit pixel of the plurality of unit pixels may have a target gray level when the second voltage is applied to a third pixel electrode corresponding to the third unit pixel during the first sub-frame through a m-th sub-frame and when the common voltage is applied to the third pixel electrode during a (m+1)-th sub-frame through the n-th sub-frame, where m is a natural number>=one and <=(n−1). The target gray level may correspond to a sum of a sub-frame period of the first sub-frame through a sub-frame period of the m-th sub-frame.

A reflectance of the third unit pixel may decrease as m increases.

A first unit pixel of the plurality of unit pixels may have a lightest gray level when the second voltage is applied to a first pixel electrode corresponding to the first unit pixel during the first sub-frame through the n-th sub-frame. A second unit pixel of the plurality of unit pixels may have a darkest gray level when the common voltage is applied to a second pixel electrode corresponding to the second unit pixel during the first sub-frame through the n-th sub-frame.

The plurality of sub-frames may include first through n-th sub-frames, where n is a natural number>=two. A sub-frame period of a k-th sub-frame may be smaller than a sub-frame period of a (k−1)-th sub-frame, where k is a natural number>=two and <=n.

A first unit pixel of the plurality of unit pixels may be set to a target gray level when the common voltage is applied to a first pixel electrode corresponding to the first unit pixel during the first sub-frame through a m-th sub-frame and when the second voltage is applied to the first pixel electrode during a (m+1)-th sub-frame through the n-th sub-frame, where m is a natural number>=one and >=(n−1). The target gray level may be set during a period that corresponds to a sum of a sub-frame period of the (m+1)-th sub-frame through a sub-frame period of the n-th sub-frame.

The sub-frame periods of the plurality of sub-frames may be determined based on a sub-frame control signal and period information stored in a look-up table of the electrophoretic display device.

A pause sub-frame may be inserted between a first sub-frame and a second sub-frame of the plurality of sub-frames based on the sub-frame control signal, where the common voltage is applied to the plurality of pixel electrodes during the pause sub-frame.

At least one of the sub-frame periods of the plurality of sub-frames may be changed based on the sub-frame control signal.

One of the common voltage and the second voltage may be selectively applied to each of first pixel electrodes included in a first row of the plurality of unit pixels during each sub-frame based on an image signal and an image control signal. One of the common voltage and the second voltage may be selectively applied to each of second pixel electrodes included in a second row of the plurality of unit pixels during each sub-frame based on the image signal and the image control signal.

The controlled gray levels of the plurality of unit pixels may be maintained by applying the common voltage to the plurality of pixel electrodes after all of the sub-frame periods elapse.

The number of the plurality of the sub-frames within an image period may be the same during at least two consecutive image periods of the display device.

According to an exemplary embodiment of the inventive concept, a method of driving an electrophoretic display device having a common electrode and a plurality of pixels is provided. The method includes applying a common voltage to the common electrode and a first voltage to pixel electrodes of the pixels during a first image period of the display device, applying a second voltage to a pixel electrode of a first one of the pixels during a second image period of the display device subsequent to the first image period, applying the second voltage to a pixel electrode of a second one of the pixels during a first part of the second image period, and applying the common voltage to the pixel electrode of the second pixel during a second part of the second image period subsequent to the first part. A period of the first part differs from a period of the second part and the common voltage is in between the first and second voltages.

The method may further include applying the common voltage to a pixel electrode of a third one of the pixels during the second image period. The method may further include applying the common voltage to the common electrode and to the pixel electrodes during a third image period of the device after the second image period. The method may apply the common voltage to the pixel electrode of the second pixel during a third part of the second image period that is between the first and second parts.

According to an exemplary embodiment of the inventive concept, an electrophoretic display device includes a display panel, a gate driving unit, and a data driving unit. The display panel includes a plurality of pixels and a common electrode receiving a common voltage. Each pixel includes a pixel electrode and electrophoretic elements located between the pixel electrode and the common electrode. The gate driving unit is configured to apply gate signals to gate lines of the display panel connected to the pixels during sub-frame periods of an image period of the device. The data driving unit is configured to apply one of a first voltage, a second voltage, and the common voltage to a data line of the display panel connected to a corresponding one of the pixels during the sub-frame periods. The sub-frame periods differ from one another and the common voltage is between the first and second voltages.

The data driving unit may be configured to a) apply the first voltage to all the pixel electrodes during a first image period, b) apply the second voltage to a pixel electrode of a first one of the pixels during a second image period, c) apply the second voltage to a pixel electrode of a second one of the pixels during a first part of the second image period, and d) apply the common voltage to the pixel electrode of the second pixel during a second part of the second image period subsequent to the first part.

BRIEF DESCRIPTION OF THE DRAWINGS

Exemplary embodiments of the inventive concept will be more clearly understood from the following detailed description taken in conjunction with the accompanying drawings.

FIG. 8 is a table illustrating another example of the plurality of sub-frames that may be used with the method of FIG. 1.

FIG. 14 is a table illustrating still another example of the plurality of sub-frames that may be with the method of FIG. 1.

FIG. 17 is a table illustrating still another example of the plurality of sub-frames that may be used with the method of FIG. 1.

DETAILED DESCRIPTION

Figure 1:
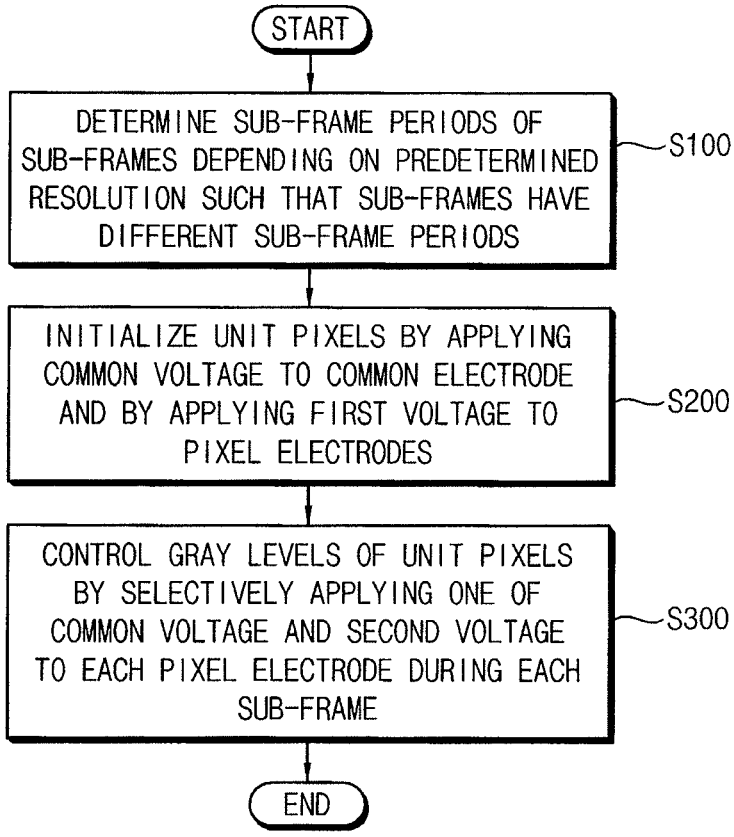
FIG. 1 is a flow chart illustrating a method of driving an electrophoretic display device according to an exemplary embodiment of the inventive concept.

The inventive concept will be described more fully with reference to the accompanying drawings, in which exemplary embodiments thereof are shown. The inventive concept may, however, be embodied in many different forms and should not be construed as limited to the exemplary embodiments set forth herein. Like reference numerals refer to like elements throughout this application.

It will be understood that when an element is referred to as being "connected" or "coupled" to another element, it can be directly connected or coupled to the other element or intervening elements may be present.

FIG. 1 is a flow chart illustrating a method of driving an electrophoretic display device according to an exemplary embodiment of the inventive concept.

The method illustrated in FIG. 1 may be applied to drive an electrophoretic display device including a plurality of unit pixels. Each unit pixel may have a common electrode, a pixel electrode and an electrophoretic element disposed between the common electrode and the pixel electrode. The plurality of unit pixels may share the common electrode. Detailed configurations of an electrophoretic display device and a unit pixel will be described below with reference to FIGS. 2 and 3.

Referring to FIG. 1, the electrophoretic display device is driven by the method to display an image during an image frame that is divided into a plurality of sub-frames. The sub-frame periods of the plurality of sub-frames are determined depending on a predetermined resolution of the image (step S100). The plurality of unit pixels included in the electrophoretic display device are initialized by applying a common voltage to a common electrode and by applying a first voltage to the plurality of pixel electrodes (step S200). Each pixel electrode corresponds to a respective one of the plurality of unit pixels. The gray levels of the plurality of unit pixels are controlled by selectively applying one of the common voltage and a second voltage to each pixel electrode during each sub-frame (step S300). The controlled gray levels of the plurality of unit pixels may be maintained by applying the common voltage to the plurality of pixel electrodes after all of the sub-frame periods elapse.

The plurality of sub-frames have different sub-frame periods. For example, the widths of at least two or all of the sub-frame periods during a single frame period differ from one another. The plurality of sub-frames may include first through n-th sub-frames, where n is a natural number>=two. In an exemplary embodiment of the inventive concept, as described below with reference to FIG. 5, a sub-frame period (e.g., a time period corresponding to a k-th sub-frame) of a k-th sub-frame may be greater than a sub-frame period of a (k−1)-th sub-frame, where k is a natural number>=two and <=n. In another exemplary embodiment of the inventive concept, as described below with reference to FIG. 12, the sub-frame period of the k-th sub-frame may be smaller than the sub-frame period of the (k−1)-th sub-frame. A sub-frame period of each sub-frame may be variable, and the number of the plurality of the sub-frames may be fixed. For example, the width of any particular sub-frame period need not be limited to any fixed amount. Further, the display can be driven with a constant number of these sub-frame periods. For example, if the display is driven using three sub-frame periods of different widths during a first frame period, it can be driven during a second subsequent frame period using the same three sub-frame periods.

The step S100 of determining the sub-frame period may be implemented according to various exemplary embodiments of the inventive concept. In an exemplary embodiment of the inventive concept, as described below with reference to FIG. 2, the sub-frame periods of the plurality of sub-frames may be determined based on a sub-frame control signal and period information stored in a look-up table. In this embodiment, the sub-frame periods are determined at an initial operation time point or period, and the determined sub-frame periods are maintained until the electrophoretic display device receives an additional command for changing the sub-frame periods. In another exemplary embodiment of the inventive concept, as described below with reference to FIGS. 10 and 11, a pause sub-frame is inserted between a first sub-frame and a second sub-frame of the plurality of sub-frames based on the sub-frame control signal. In this embodiment, the common voltage is applied to the plurality of pixel electrodes during the pause sub-frame, and the movements of the conductive particles included in each unit pixel may be temporarily stopped. In still another exemplary embodiment of the inventive concept, after the sub-frame periods are determined, at least one of the sub-frame periods of the plurality of sub-frames is further changed based on the sub-frame control signal.

In an exemplary embodiment of the inventive concept, a level of the first voltage may be higher than a level of the common voltage, and a level of the second voltage may be lower than the level of the common voltage. For example, the common voltage may have a ground voltage level (e.g., about 0V), the first voltage may have a positive high voltage level (e.g., about 15V), and the second voltage may have a negative high voltage level (e.g., about −15V). In another exemplary embodiment of the inventive concept, the level of the first voltage may be lower than the level of the common voltage, and the level of the second voltage may be higher than the level of the common voltage.

Hereinafter, methods of driving the electrophoretic display device according to exemplary embodiments of the inventive concept will be explained in detail with reference to exemplary configurations of the electrophoretic display device and the unit pixel.

Figure 2:
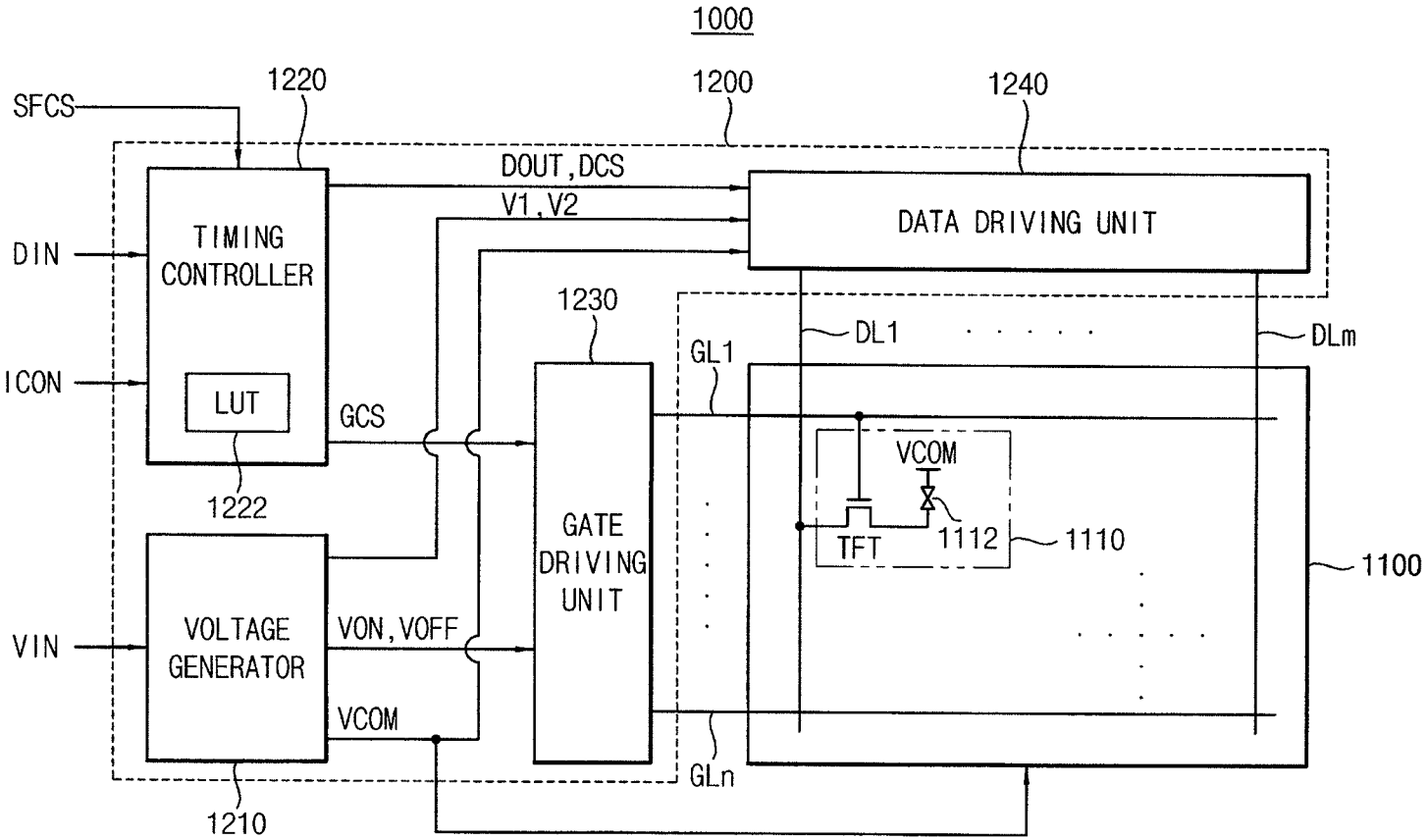
FIG. 2 is a block diagram illustrating an electrophoretic display device according to an exemplary embodiment of the inventive concept that may be driven by the method of FIG. 1.

FIG. 2 is a block diagram illustrating an electrophoretic display device according to an exemplary embodiment of the inventive concept that may be driven by the method of FIG. 1.

Referring to FIG. 2, the electrophoretic display device 1000 includes an electrophoretic display panel 1100 and a driving circuit 1200.

The electrophoretic display panel 1100 includes a plurality of unit pixels 1110. The plurality of unit pixels 1110 may be arranged in a matrix form and may form a pixel array. Each unit pixel 1110 may be connected to one of a plurality of gate lines GL1, . . . , GLn and one of a plurality of data lines DL1, . . . , DLm. Each unit pixel 1110 may include an electrophoretic element 1112 and a thin-film transistor TFT for driving the electrophoretic element 1112.

Figure 3:
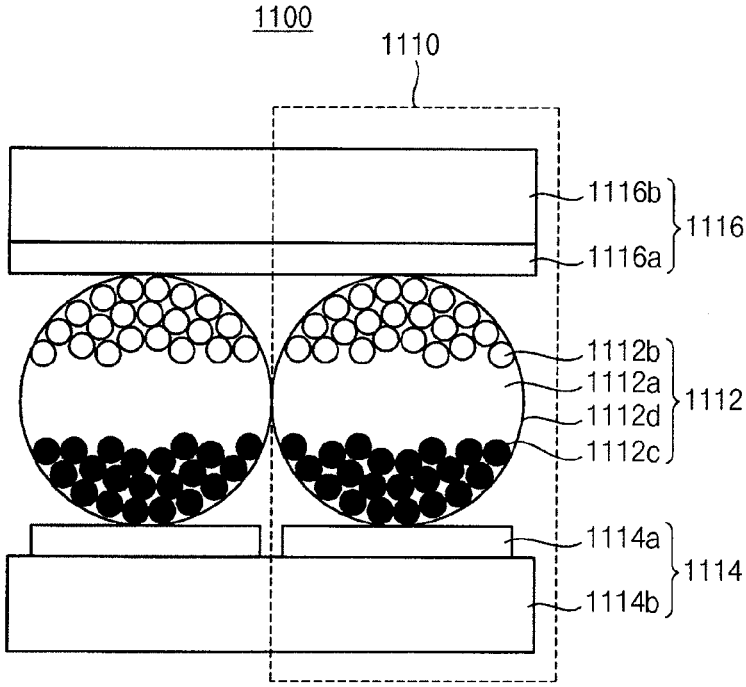
FIG. 3 is a cross-sectional view of an electrophoretic display panel included in the electrophoretic display device of FIG. 2 according to an exemplary embodiment of the inventive concept.

FIG. 3 is a cross-sectional view of the electrophoretic display panel included in the electrophoretic display device of FIG. 2 according to an exemplary embodiment of the inventive concept.

Referring to FIG. 3, the electrophoretic display panel 1100 includes a first substrate 1114, a second substrate 1116 and the electrophoretic elements 1112 disposed between the first substrate 1114 and the second substrate 1116.

Each electrophoretic element 1112 may include a dielectric fluid 1112*a*, a plurality of conductive particles 1112*b* and 1112*c* and a case 1112*d*.

The case 1112*d* may be a transparent thin-film. The dielectric fluid 1112*a* and the plurality of conductive particles 1112*b* and 1112*c* may be filled (located) in the case 1112*d*. The case 1112*d* may have a micro-capsule structure or a micro-cup structure. The dielectric fluid 1112*a* may be a transparent fluid or may have different colors.

The plurality of conductive particles 1112*b* and 1112*c* may include first conductive particles 1112*b* and second conductive particles 1112*c*. The plurality of conductive particles 1112*b* and 1112*c* may be distributed in the dielectric fluid 1112*a* and may have different colors. For example, the first conductive particles 1112*b* may be white, and the second conductive particles 1112*c* may be black. The plurality of conductive particles 1112*b* and 1112*c* may be electrified with opposite polarities. For example, the first conductive particles 1112*b* may be charged with a first polarity (e.g., a positive polarity), and the second conductive particles 1112*c* may be charged with a second polarity (e.g., a negative polarity).

Although the electrophoretic element 1112 having the case 1112*d* with a spherical micro-capsule structure, a transparent dielectric fluid 1112*a*, white conductive particles 1112*b* and black conductive particles 1112*c* is illustrated in FIG. 3, the electrophoretic element 1112 is not limited thereto. For example, the electrophoretic element 1112 may have differently shaped cases 1112*d* such as elliptical micro-capsule structures or micro-cup structures. The electrophoretic element 1112 may include a single type of conductive particles (e.g., all white conductive particles with the positive polarity) and a colored dielectric fluid (e.g., black dielectric fluid). Alternatively, the electrophoretic element 1112 may include a plurality of conductive particles having various colors.

The first substrate 1114 may include a plurality of pixel electrodes 1114*a* and a first insulation substrate 1114*b*. Although not illustrated in FIG. 3, the first substrate 1114 may further include the thin-film transistors TFT, the gate lines GL1, . . . , GLn and the data lines DL1, . . . , DLm.

The first insulation substrate 1114*b* may include a smooth or flexible paper-like material. The gate lines GL1, . . . , GLn may be formed on the first insulation substrate 1114*b*. The data lines DL1, . . . , DLm may be formed on the gate lines GL1, . . . , GLn and may be intersect with the gate lines GL1, . . . , GLn. An insulation layer (not illustrated) may be formed between the gate lines GL1, . . . , GLn and the data lines DL1, . . . , DLm.

The thin-film transistors TFT and the plurality of pixel electrodes 1114*a* may be formed on the data lines DL1, . . . , DLm and may be disposed in each row and each column. Each thin-film transistor TFT may have a gate electrode connected to one of the gate lines GL1, . . . , GLn, a first electrode (e.g., a source) connected to one of the data lines DL1, . . . , DLm and a second electrode (e.g., a drain) connected to one of the pixel electrodes 1114*a*. The thin-film transistors TFT may include silicon, poly silicon, amorphous silicon, etc. Each pixel electrode 1114*a* may receive one of a common voltage VCOM, a first voltage V1 and a second voltage V2. The pixel electrodes 1114*a* may be implemented with a transparent conductive material or a reflective conductive material. The first insulation substrate 1114*b* may further include a plurality of capacitors (not illustrated) each of which is connected between the second electrode of a respective one of thin-film transistors TFT and a ground voltage, and stores charges provided through a respective one of data lines DL1, . . . , DLm.

The second substrate 1116 may include a common electrode 1116*a* and a second insulation substrate 1116*b*.

The second insulation substrate 1116*b* may include a smooth or flexible paper-like transparent material. The common electrode 1116*a* may receive the common voltage VCOM. The common electrode 1116*a* may be implemented with a transparent conductive material such as indium tin oxide (ITO), indium zinc oxide (IZO), etc. The image displayed on the electrophoretic display panel 1100 may be provided to at least one viewer through the second substrate 1116.

Although not illustrated in FIG. 3, the first substrate 1114 may further include an adhesive layer that is formed between the electrophoretic elements 1112 and the pixel electrodes 1114*a*. The second substrate 1116 may further include an adhesive layer that is formed between the electrophoretic elements 1112 and the common electrode 1116*a*. The electrophoretic elements 1112 may be fixed by the adhesive layers.

The gray level of the unit pixel 1110 may be controlled by changing positions of the conductive particles 1112*b* and 1112*c* in the electrophoretic element 1112. For example, a reflectance of the unit pixel 1110 may increase when the first conductive particles 1112*b* are adjacent the common electrode 1116*a* and the second conductive particles 1112*c* are adjacent the pixel electrode 1114*a*, and thus the unit pixel 1110 may have a relatively bright gray level. The reflectance of the unit pixel 1110 may decrease when the first conductive particles 1112*b* are adjacent the pixel electrode 1114*a* and the second conductive particles 1112*c* are adjacent the common electrode 1116*a*, and thus the unit pixel 1110 may have a relatively dark gray level.

Referring back to FIG. 2, the driving circuit 1200 may include a voltage generator 1210, a timing controller 1220, a gate driving unit 1230 and a data driving unit 1240.

The voltage generator 1210 may generate internal voltages that are used in the electrophoretic display device 1000. The voltage generator 1210 may generate the common voltage VCOM, the first voltage V1, the second voltage V2, a gate-on voltage VON and a gate-off voltage VOFF based on an input voltage VIN. The voltage generator 1210 may receive the input voltage VIN from an external device such as a power supply device. The voltage generator 1210 may provide the common voltage VCOM to the data driving unit 1240 and the common electrode 1116*a* in the electrophoretic display panel 1100, may provide the first and second voltage V1 and V2 to the data driving unit 1240, and may provide the gate-on voltage VON and the gate-off voltage VOFF to the gate driving unit 1230.

The timing controller 1220 may generate an output image signal DOUT, a data control signal DCS and a gate control signal GCS based on an input image signal DIN and an image control signal ICON. The timing controller 1220 may receive the input image signal DIN and the image control signal ICON from an external device such as a graphic processing unit (GPU). The output image signal DOUT may include gray level information that corresponds to an image displayed on the electrophoretic display panel 1100.

The image control signal ICON may include a vertical synchronization signal, a horizontal synchronization signal, a main clock signal, a data enable signal, etc. The data control signal DCS may include a data start signal, a load signal, a data clock signal, etc. The gate control signal GCS may include a gate start signal, an output enable signal, a gate clock signal, etc.

In an exemplary embodiment of the inventive concept, the timing controller 1220 may determine and change the sub-frame periods of the plurality of sub-frames based on a sub-frame control signal SFCS. The timing controller 1220 may receive the sub-frame control signal SFCS from the external device (e.g., the GPU). The timing controller 1220 may include a look-up table 1222 that stores period information with respect to the sub-frame periods (e.g., sub-frame frequencies). The timing controller 1220 may determine the sub-frame periods based on the period information stored in the look-up table 1222 such that the plurality of sub-frames have different sub-frame periods, and may change at least one of the sub-frame periods based on the period information stored in the look-up table 1222, and thus the electrophoretic display device 1000 driven by the method of FIG. 1 may effectively control the gray levels of the unit pixels 1110.

The gate driving unit 1230 may apply one of the gate-on voltage VON and the gate-off voltage VOFF to the gate lines GL1, . . . , GLn based on the gate control signal GCS. The data driving unit 1240 may apply one of the common voltage VCOM, the first voltage V1 and the second voltage V2 to the data lines DL1, . . . , DLm based on the data control signal DCS.

In an exemplary embodiment of the inventive concept, the driving circuit 1200 is fabricated as integrated circuit (IC) chips that are mounted on a separate printed circuit board (PCB) (not illustrated) on the electrophoretic display panel 1100 or on a flexible printed circuit (FPC) film (not illustrated) in a tape carrier package (TCP), which is attached to the electrophoretic display panel 1100. In another exemplary embodiment of the inventive concept, the driving circuit 1200 is fabricated as a single IC chip. When the driving circuit 1200 is fabricated as a single IC chip, at least one of the voltage generator 1210, the timing controller 1220, the gate driving unit 1230 and the data driving unit 1240 may be provided outside the single IC chip. Alternatively, the driving circuit 1200 may be integrated into the electrophoretic display panel 1100 along with the gate lines GL1, . . . , GLn and the data lines DL1, . . . , DLm.

Hereinafter, an operation of the electrophoretic display device 1000 will be described with reference to FIGS. 1, 2 and 3.

As described above with reference to FIG. 1, the electrophoretic display device 1000 displays a target image by determining the sub-frame periods, initializing the plurality of unit pixels 1110, controlling the gray levels of the unit pixels 1110 during the sub-frame periods, and maintaining the controlled gray levels of the unit pixels 1110.

In the determining step (e.g., step S100 of FIG. 1), the timing controller 1220 determines the sub-frame periods based on the sub-frame control signal SFCS and the period information stored in the look-up table 1222 such that the plurality of sub-frames have different sub-frame periods. In an alternate embodiment, the timing controller 1220 determines the sub-frame period based on only on the period information stored in the lookup-table 1222. The timing controller 1220 may further insert the pause sub-frame, or may change at least one of the sub-frame periods, according to alternate embodiments of the inventive concept.

In the initializing step (e.g., step S200 of FIG. 1), the common voltage VCOM is applied to the common electrode 1116*a*, and the first voltage V1 is applied to each pixel electrode 1114*a*. The first voltage V1 may be sequentially applied to the pixel electrodes 1114*a* row by row, that is, by units of rows of the electrophoretic display panel 1100. Thus, all of the unit pixels 1110 are initialized, and the electrophoretic display panel 1100 displays an initial image (e.g., a white image). In an alternate embodiment, the initializing takes place only with respect to a portion of the unit pixels 1110.

In the controlling step (e.g., step S300 of FIG. 1), the timing controller 1220 converts the input image signal DIN into the output image signal DOUT for driving the electrophoretic display panel 1100. The timing controller 1220 provides the gate control signal GCS to the gate driving unit 1230 and provides the output image signal DOUT and the data control signal DCS to the data driving unit 1240.

The data driving unit 1240 applies one of the common voltage VCOM and the second voltage V2 to the data lines DL1, . . . , DLm based on the data control signal DCS such that the voltages of the data lines DL1, . . . , DLm correspond to the target image displayed on the electrophoretic display panel 1100. The gate driving unit 1230 applies one of the gate-on voltage VON and the gate-off voltage VOFF to the gate lines GL1, . . . , GLn and the thin-film transistors TFT based on the gate control signal GCS. The thin-film transistors TFT receiving the gate-on voltage VON are turned on, and the voltages of the data lines DL1, . . . , DLm are applied to the pixel electrodes 1114*a* connected to the turned-on thin-film transistors TFT.

The operations of the data driving unit 1240 and the gate driving unit 1230 may be sequentially performed row by row. For example, the data driving unit 1240 may apply first data voltages corresponding to a first row of the unit pixels 1110 to the data lines DL1, . . . , DLm based on the data control signal DCS. Each first data voltage may be one of the common voltage VCOM and the second voltage V2. The gate driving unit 1230 may apply the gate-on voltage VON to a first gate line GL1 and the gate-off voltage VOFF to the other gate lines. The first data voltages may be applied to first pixel electrodes of the first unit pixels connected to the first gate line GL1.

The common voltage VCOM is applied to the common electrode 1116*a*, and the first data voltages are applied to the first pixel electrodes. Thus, an electric field in each electrophoretic element 1112 is generated by a voltage difference between the common electrode 1116*a* and each first pixel electrode. The conductive particles 1112*b* and 1112*c* in each electrophoretic element 1112 move depending on the electric field. The positions of the conductive particles 1112*b* and 1112*c* in each electrophoretic element 1112 may be changed, and each first unit pixel may display a first row of the target image by absorbing or reflecting an incident light.

The data driving unit 1240 and the gate driving unit 1230 repeat such operations from a second row to a n-th row of the electrophoretic display panel 1100. The electrophoretic display panel 1100 displays the target image corresponding to the output image signal DOUT when such operations from the first row to the n-th row is finished.

In the maintaining step, the common voltage VCOM is applied to the common electrode 1116*a* and to each pixel electrode 1114*a*. The common voltage VCOM may be sequentially applied to the pixel electrodes 1114*a* row by row. Thus, the voltage difference between the common electrode 1116*a* and each pixel electrode 1114*a* becomes substantially the same as zero, all of the conductive particles 1112*b* and 1112*c* in each electrophoretic element 1112 do not move, and the electrophoretic display panel 1100 maintains the target image.

Figure 4:
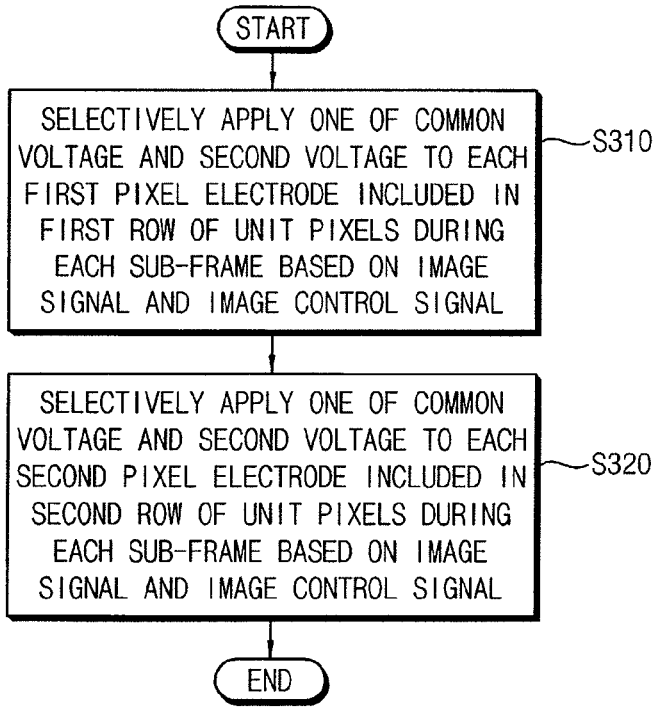
FIG. 4 is a flow chart illustrating a method of controlling gray levels of a plurality of unit pixels of the electrophoretic display device according to an exemplary embodiment of the inventive concept.

FIG. 4 is a flow chart illustrating an example of controlling gray levels of a plurality of unit pixels of FIG. 1 according to an exemplary embodiment of the inventive concept.

Referring to FIG. 4, in the step S300, one of the common voltage and the second voltage may be selectively applied to each of first pixel electrodes included in a first row of the plurality of unit pixels during each sub-frame based on an image signal and an image control signal (step S310). One of the common voltage and the second voltage may be selectively applied to each of second pixel electrodes included in a second row of the plurality of unit pixels during each sub-frame based on the image signal and the image control signal (step S320). As described above with reference to FIG. 2, the electrophoretic display device 1000 may repeat such applying operations from the first row to the n-th row of the electrophoretic display panel 1100.

In an electrophoretic display device, conductive particles included in each unit pixel move depending on an electric field induced on each unit pixel. Moving directions and moving distances of the conductive particles are determined based on a bias voltage level and a biasing time applied to a pixel electrode of each unit pixel. To accurately control gray levels of the unit pixels in the electrophoretic display device, moving directions and moving distances of the conductive particles need to be precisely controlled. In one method of driving the electrophoretic display device, an image frame is divided into a plurality of sub-frames having the same sub-frame periods, and gray levels of unit pixels are controlled by changing a polarity of a bias voltage applied to each pixel electrode during each sub-frame. For example, in this method, an image frame includes positive-biased sub-frames and negative-biased sub-frames. A positive bias voltage is applied to the pixel electrode during each positive-biased sub-frame, and a negative bias voltage is applied to the pixel electrode during each negative-biased sub-frame. The movement of the conductive particles and the gray levels of the unit pixels are controlled by arranging the positive-biased sub-frames and the negative-biased sub-frames with various orders in a single image frame. However, this method requires a relatively large number of sub-frames, and thus the time period of a single image frame may be larger than desired.

In a method of driving the electrophoretic display device according to an exemplary embodiment of the inventive concept, the plurality of sub-frames have different sub-frame periods. The number of the sub-frames included in a single image frame may be fixed, and a time period (e.g., a frame frequency) of one sub-frame is different from time periods of the other sub-frames. The gray levels of the plurality of unit pixels are controlled by selectively applying one of the common voltage and the second voltage to each pixel electrode during each sub-frame. Thus, the movement of the conductive particles 1112*b* and 1112*c* may be precisely controlled, and the gray levels of the plurality of unit pixels may be effectively controlled.

Figure 5:
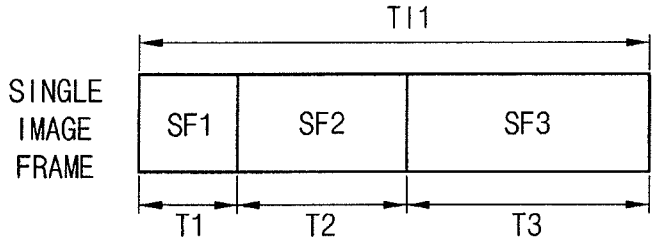
FIG. 5 is a diagram illustrating an example of a plurality of sub-frames that may be used with the method of FIG. 1.

FIG. 5 is a diagram illustrating an example of a plurality of sub-frames used to describe the method of FIG. 1.

Referring to FIG. 5, a plurality of sub-frames may form a single image frame, and may include a first sub-frame SF1, a second sub-frame SF2 and a third sub-frame SF3.

The sub-frame periods of the sub-frames SF1, SF2 and SF3 may sequentially increase. For example, a second sub-frame period T2 of a second sub-frame SF2 may be greater than a first sub-frame period T1 of a first sub-frame SF1. A third sub-frame period T3 of a third sub-frame SF3 may be greater than the second sub-frame period T2 of the second sub-frame SF2. A sum of the sub-frame periods T1, T2 and T3 may be substantially the same as a frame period TI1 of the single image frame.

In the method of driving the electrophoretic display device according to an exemplary embodiment of the inventive concept, the movement of the conductive particles (e.g., the conductive particles 1112*b* and 1112*c* in FIG. 3) may be controlled by applying one of the common voltage (e.g., VCOM in FIG. 2), the first voltage (e.g., V1 in FIG. 2) and the second voltage (e.g., V2 in FIG. 2) to each pixel electrode (e.g., the pixel electrode in FIG. 3) during each of the sub-frames SF1, SF2 and SF3.

For convenience of illustration, a single image frame including three sub-frames is illustrated in FIG. 5. However, the number of sub-frames included in a single image frame is not limited thereto. For example, there may be more than three sub-frames or less than three sub-frames.

Figure 6A:
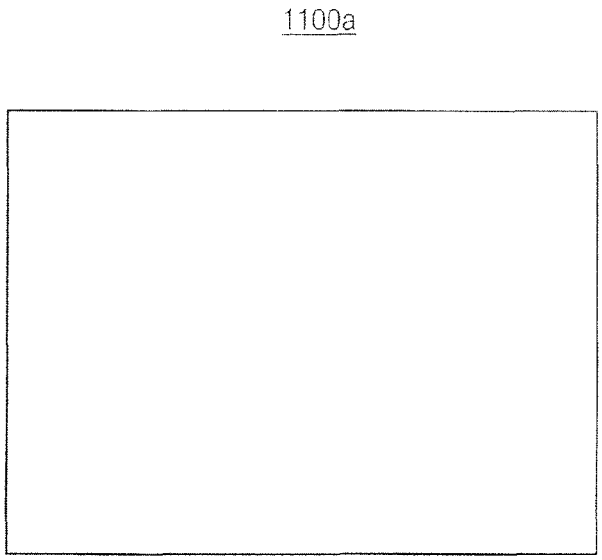
FIGS. 6A and 6B are diagrams illustrating exemplary images that may be displayed on an electrophoretic display panel included in the electrophoretic display device of FIG. 2.
Figure 6B:
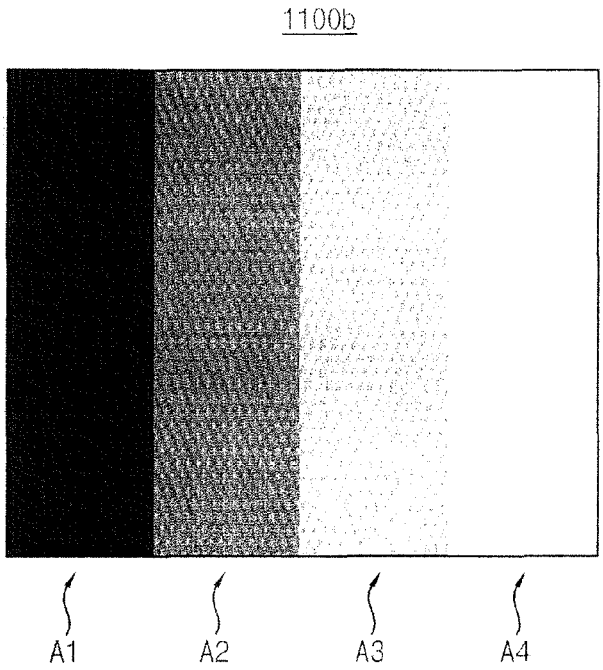

FIGS. 6A and 6B are diagrams illustrating examples of images displayed on an electrophoretic display panel included in the electrophoretic display device of FIG. 2. FIG. 6A illustrates an example of an initial image 1100*a* displayed on the electrophoretic display panel 1100 after the initializing step (e.g., the step S200 in FIG. 1). FIG. 6B illustrates an example of a target image 1100*b* displayed on the electrophoretic display panel 1100 after the controlling step (e.g., the step S300 in FIG. 1).

Referring to FIGS. 6A and 6B, the target image 1100*b* may include four areas having different gray levels. A first area A1 of the target image 1100*b* may have a first gray level (e.g., black color) that corresponds to the darkest gray level. A second area A2 of the target image 1100*b* may have a second gray level (e.g., dark gray color) that is lighter than the first gray level. A third area A3 of the target image 1100*b* may have a third gray level (e.g., light gray color) that is lighter than the second gray level. A fourth area A4 of the target image 1100*b* may have a fourth gray level (e.g., white color) that corresponds to a lightest gray level. The initial image 1100*a* may have the fourth gray level.

FIGS. 7A, 7B, 7C, 7D and 7E are diagrams for describing the method of driving the electrophoretic display device of FIG. 1. FIGS. 7A, 7B, 7C, 7D and 7E illustrate the variation of a voltage applied to an adjusted pixel electrode of an adjusted pixel. As used herein, the term "adjusted pixel" indicates one of the plurality of unit pixels of which the gray level is controlled. The term "adjusted pixel electrode" indicates a pixel electrode included in the adjusted pixel.

In FIGS. 7A, 7B, 7C, 7D and 7E, a level of the first voltage V1 is higher than a level of the common voltage VCOM, and a level of the second voltage V2 is lower than the level of the common voltage VCOM. It is assumed that the first conductive particles 1112*b* (e.g., white conductive particles) are charged with a positive polarity, and the second conductive particles 1112*c* (e.g., black conductive particles) are charged with a negative polarity.

In an initial operation time, the sub-frame periods of the sub-frames SF1, SF2 and SF3 are determined (the determining step). A first time interval from about 0 to time t1 is substantially the same as the first sub-frame period T1 in FIG. 5, a second time interval from time t1 to time t2 is substantially the same as the second sub-frame period T2 in FIG. 5, and a third time interval from time t2 to time t3 is substantially the same as the third sub-frame period T3 in FIG. 5.

Referring to FIGS. 2, 3, 6A and 7A, the plurality of unit pixels 1110 are initialized during a first image frame including three sub-frames SF1, SF2 and SF3 (the initializing step). During the first, second and third sub-frames SF1, SF2 and SF3, the common voltage VCOM is applied to the common electrode 1116*a*, and the first voltage V1 is applied to the plurality of pixel electrodes 1114*a*. The white conductive particles 1112*b* in each unit pixel move toward the common electrode 1116*a*, and the black conductive particles 1112*c* in each unit pixel move toward each pixel electrode 1114*a* because the level of the first voltage V1 is higher than the level of the common voltage VCOM. The white conductive particles 1112*b* are disposed adjacent the common electrode 1116*a* in the electrophoretic element 1112, the black conductive particles 1112*c* are disposed adjacent each pixel electrode 1114*a* in the electrophoretic element 1112, and thus all of the unit pixels 1110 have the fourth gray level (e.g., a white color). The electrophoretic display panel 1100 displays the initial image 1100*a*.

Referring to FIGS. 2, 3, 6B, 7B, 7C, 7D and 7E, during a second image frame including three sub-frames SF1, SF2 and SF3 after the first image frame, the gray levels of the unit pixels 1110 are controlled by selectively applying one of the common voltage VCOM and the second voltage V2 to each pixel electrode 1114*a* during each of the sub-frames SF1, SF2 and SF3 (the controlling step). In other words, the moving distance of the conductive particles 1112*b* and 1112*c* in each unit pixel 1110 may be controlled by adjusting an applying time of the second voltage V2. Thus, the gray levels of the unit pixels 1110 may be controlled, and the electrophoretic display panel 1100 displays the target image 1100*b* having various gray levels.

Figure 7A:
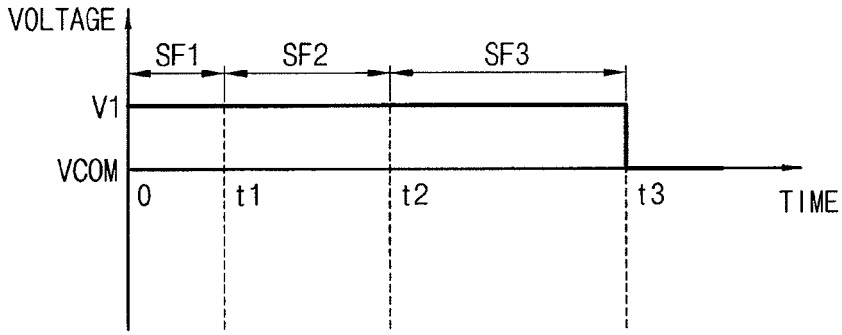
FIGS. 7A, 7B, 7C, 7D and 7E are diagrams for describing the method of driving the electrophoretic display device of FIG. 1.
Figure 7B:
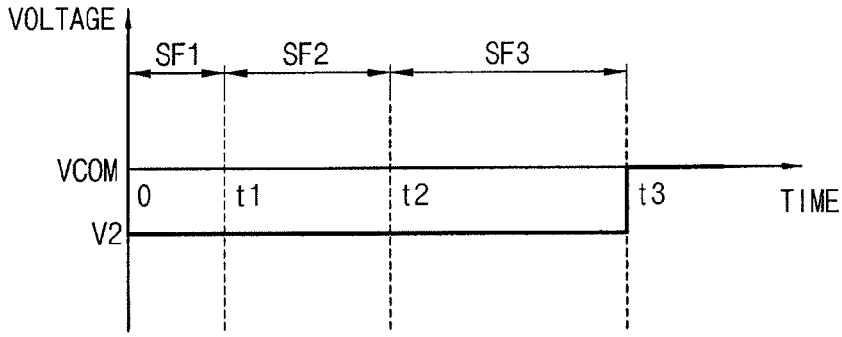

As illustrated in FIG. 7B, during the first, second and third sub-frames SF1, SF2 and SF3, the common voltage VCOM is applied to the common electrode 1116*a*, and the second voltage V2 is applied to a first adjusted pixel electrode of a first adjusted pixel. The first adjusted pixel may be disposed in the electrophoretic display panel 1100 corresponding to the first area A1 of the target image 1100*b*. The white conductive particles 1112*b* in the first adjusted pixel move toward the first adjusted pixel electrode, and the black conductive particles 1112*c* in the first adjusted pixel move toward the common electrode 1116*a* because the level of the second voltage V2 is lower than the level of the common voltage VCOM. The white conductive particles 1112*b* are disposed adjacent the first adjusted pixel electrode in the electrophoretic element 1112, the black conductive particles 1112*c* are disposed adjacent the common electrode 1116*a* in the electrophoretic element 1112. Thus, the first adjusted pixel has the first gray level (e.g., a dark color) and the lowest reflectance.

Figure 7C:
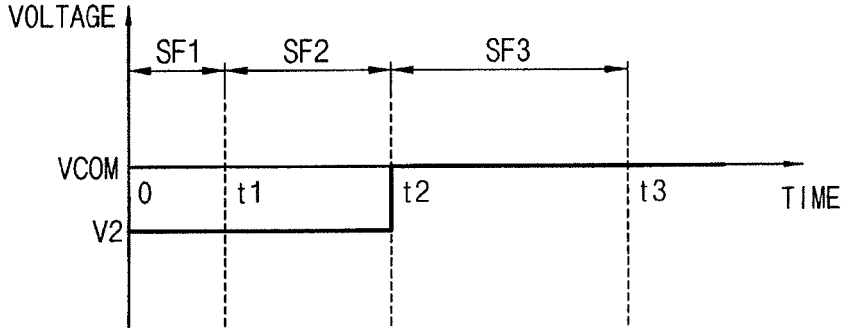

As illustrated in FIG. 7C, during the first, second and third sub-frames SF1, SF2 and SF3, the common voltage VCOM is applied to the common electrode 1116*a*. A second adjusted pixel electrode of a second adjusted pixel sequentially receives the second voltage V2 and the common voltage VCOM. For example, the second voltage V2 is applied to the second adjusted pixel electrode during the first and second sub-frames SF1 and SF2, and the common voltage VCOM is applied to the second adjusted pixel electrode during the third sub-frame SF3. The second adjusted pixel may be disposed in the electrophoretic display panel 1100 corresponding to the second area A2 of the target image 1100*b*. The white conductive particles 1112*b* in the second adjusted pixel move toward the second adjusted pixel electrode, and the black conductive particles 1112*c* in the second adjusted pixel move toward the common electrode 1116*a*. However, moving distances of the conductive particles 1112*b* and 1112*c* in the second adjusted pixel are smaller than moving distances of the conductive particles in the first adjusted pixel because an applying time of the second voltage V2 in the second adjusted pixel is shorter than an applying time of the second voltage V2 in the first adjusted pixel. For example, the second voltage V2 in FIG. 7C is applied for the first two sub-frame periods, while the second voltage in FIG. 7B is applied for all three sub-frame periods. The white conductive particles 1112*b* are disposed at a first position in the electrophoretic element 1112, and the black conductive particles 1112*c* are disposed at a second position in the electrophoretic element 1112. The first position is apart from the second adjusted pixel electrode by a first distance, and the second position is apart from the common electrode 1116*a* by the first distance. Thus, the second adjusted pixel has the second gray level (e.g., dark gray color) that is lighter than the first gray level.

Figure 7D:
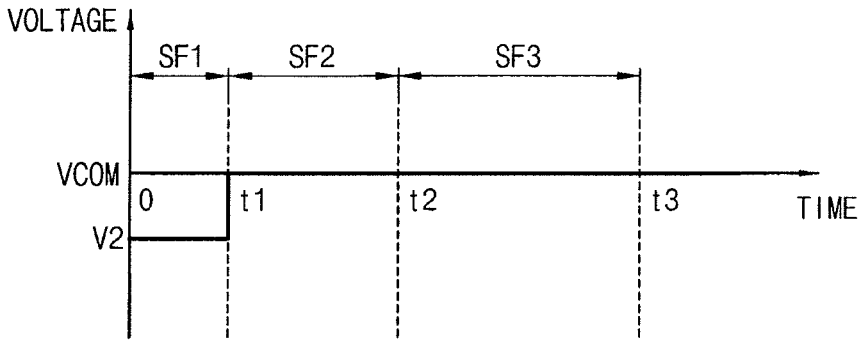

As illustrated in FIG. 7D, during the first, second and third sub-frames SF1, SF2 and SF3, the common voltage VCOM is applied to the common electrode 1116*a*. A third adjusted pixel electrode of a third adjusted pixel sequentially receives the second voltage V2 and the common voltage VCOM. For example, the second voltage V2 is applied to the third adjusted pixel electrode during the first sub-frame SF1, and the common voltage VCOM is applied to the third adjusted pixel electrode during the second and third sub-frames SF2 and SF3. The third adjusted pixel may be disposed in the electrophoretic display panel 1100 corresponding to the third area A3 of the target image 1100*b*. The white conductive particles 1112*b* in the third adjusted pixel move toward the third adjusted pixel electrode, and the black conductive particles 1112*c* in the third adjusted pixel move toward the common electrode 1116*a*. However, moving distances of the conductive particles 1112*b* and 1112*c* in the third adjusted pixel are smaller than the moving distances of the conductive particles in the second adjusted pixel because an applying time of the second voltage V2 in the third adjusted pixel is shorter than the applying time of the second voltage V2 in the second adjusted pixel. The white conductive particles 1112*b* are disposed at a third position in the electrophoretic element 1112, and the black conductive particles 1112*c* are disposed at a fourth position in the electrophoretic element 1112. The third position is apart from the third adjusted pixel electrode by a second distance that is greater than the first distance, and the fourth position is apart from the common electrode 1116*a* by the second distance. Thus, the third adjusted pixel has the third gray level (e.g., light gray color) that is lighter than the second gray level.

Figure 7E:
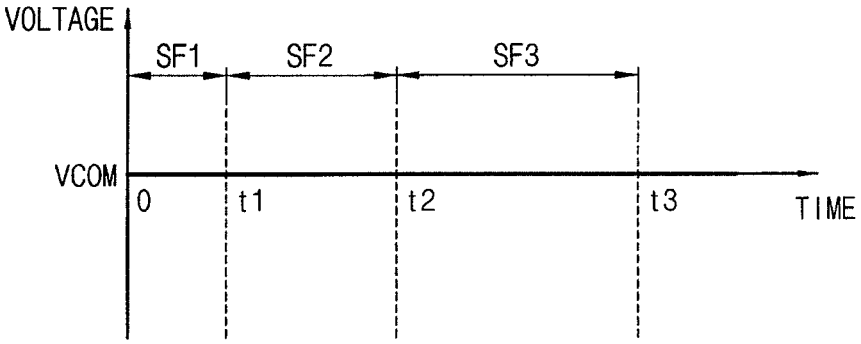

As illustrated in FIG. 7E, during the first, second and third sub-frames SF1, SF2 and SF3, the common voltage VCOM is applied to the common electrode 1116*a* and a fourth adjusted pixel electrode of a fourth adjusted pixel. The fourth adjusted pixel may be disposed in the electrophoretic display panel 1100 corresponding to the fourth area A4 of the target image 1100*b*. The conductive particles 1112*b* and 1112*c* in the fourth adjusted pixel do not move because the voltage difference between the common electrode 1116*a* and the fourth adjusted pixel electrode is substantially about zero. The white conductive particles 1112*b* are disposed adjacent the common electrode 1116*a* in the electrophoretic element 1112, the black conductive particles 1112*c* are disposed adjacent the fourth adjusted pixel electrode in the electrophoretic element 1112. Thus, the gray level of the fourth adjusted pixel is maintained at the fourth gray level.

As described above, during the second image frame, the gray level of the first adjusted pixel is changed to the first gray level, the gray level of the second adjusted pixel is changed to the second gray level, the gray level of the third adjusted pixel is changed to the third gray level, and the gray level of the fourth adjusted pixel is maintained at the fourth gray level. Thus, the electrophoretic display panel 1100 displays the target image 1100*b*.

After the second image frame, the common voltage VCOM may be applied to the common electrode 1116*a* and the plurality of pixel electrodes 1114*a*. The movements of the conductive particles 1112*b* and 1112*c* included in each unit pixel 1110 may be stopped, and thus the controlled gray levels of the plurality of unit pixels 1110 may be maintained.

The first adjusted pixel electrode may be adjacent the second adjusted pixel electrode, the second adjusted pixel electrode may be adjacent the first and third adjusted pixel electrodes, and the third adjusted pixel electrode may be adjacent the second adjusted pixel electrode and the fourth adjusted pixel electrode. The first through fourth pixel electrodes may be located in a same row of the display device. The first adjusted pixel electrode could represent a plurality of pixels in the first area A1, the second adjusted pixel electrode could represent a plurality of pixels in the second area A2, the third adjusted pixel electrode could represent a plurality of pixels in the third area A3, and the fourth adjusted pixel electrode could represent a plurality of pixels in the fourth area A4.

When the image frame is divided into two sub-frames (e.g., SF1 and SF2), the resulting target image 1100*b* could have three areas, where the first area A1 is a dark gray level, the third area A3 is a bright gray level, and the second area A2 is a gray level in between the dark and bright levels. The first voltage V1 could then be applied to all the pixel electrodes of the pixels during an entire first image frame for initialization. Next, the second voltage V2 could be applied to a first pixel electrode of one of the pixels during an entire second image frame, the second voltage could be applied to a second pixel electrode of a second one of the pixels during a first sub-frame period (e.g., SF1) of the second image frame, and the common voltage could be applied to the second pixel electrode during a second sub-frame period (e.g., SF2) of the second image frame. Next, the common voltage could be applied to a third pixel electrode of a third one of the pixels during an entire third image frame. Next, the common voltage could be applied to the first, second and third pixel electrodes or all the pixel electrodes. This process could then be repeated.

Figure 9:
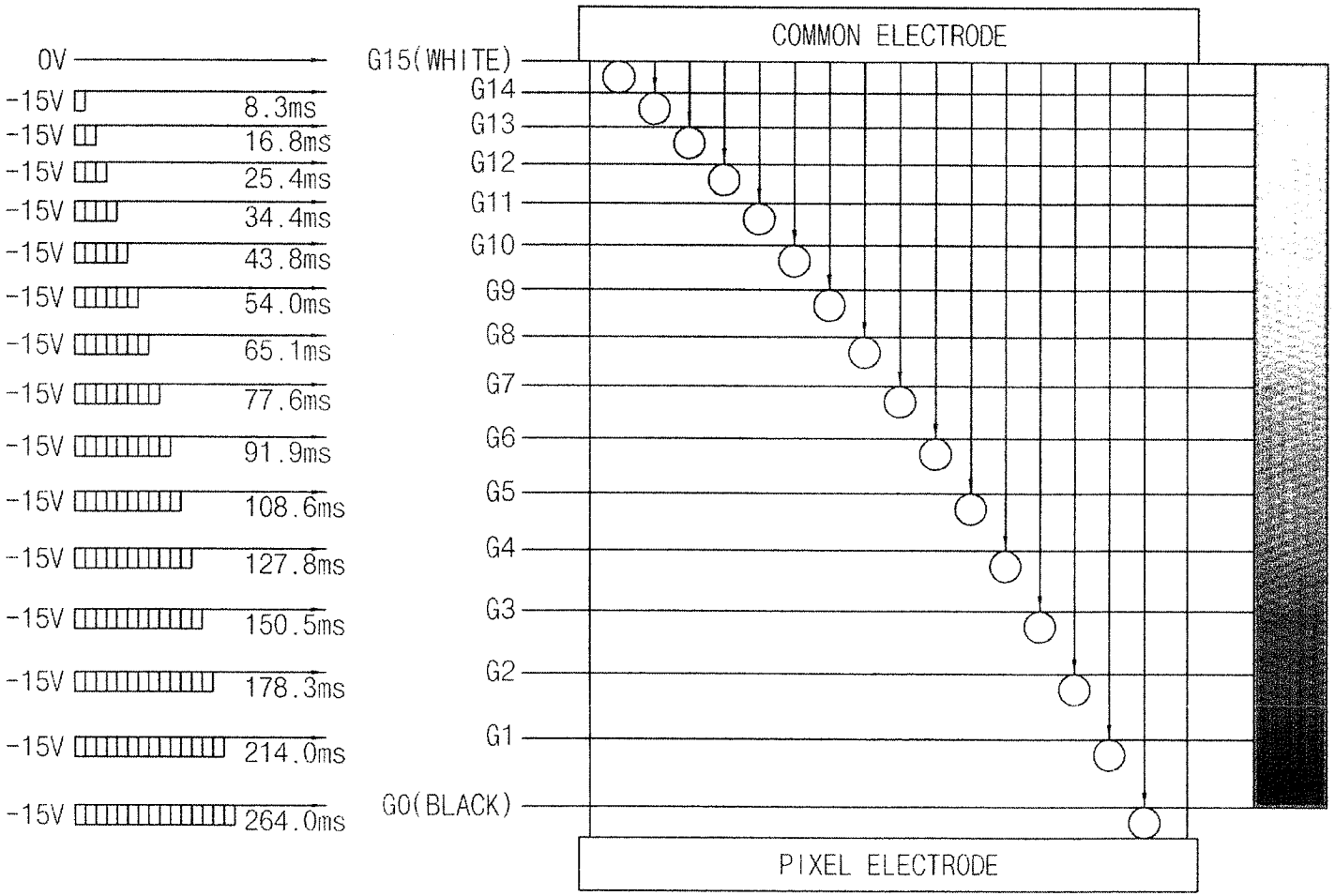
FIG. 9 is a diagram for describing the method of driving the electrophoretic display device of FIG. 1.

FIG. 8 is a table illustrating examples of the plurality of sub-frames that may be used with the method of FIG. 1. FIG. 9 is a diagram for describing the method of driving the electrophoretic display device of FIG. 1. For convenience of illustration, only white conductive particles with a positive polarity are illustrated in FIG. 9.

Referring to FIGS. 8 and 9, a single image frame may include first through fifteenth sub-frames SF1, . . . , SF15. The sub-frame periods of the sub-frames SF1, . . . , SF15 may sequentially increase. The sub-frame frequencies of the sub-frames SF1, . . . , SF15 may sequentially decrease. Each unit pixel 1110 may have one of first through sixteenth gray levels G1, . . . , G15. The first gray level G0 may correspond to a darkest gray level, and the sixteenth gray level G15 may correspond to a lightest gray level.

In an exemplary embodiment of the inventive concept, the second voltage V2 (e.g., about −15V) is applied to a first adjusted pixel electrode of a first adjusted pixel during the first through fifteenth sub-frames SF1, . . . , SF15 (e.g., during a time period of about 264.0 ms). The white conductive particles 1112*b* in the first adjusted pixel may move toward the first adjusted pixel electrode, and may be disposed adjacent the first adjusted pixel electrode. Thus, the first adjusted pixel may have the first gray level G0. In another exemplary embodiment of the inventive concept, the common voltage VCOM (e.g., about 0V) is applied to a second adjusted pixel electrode of a second adjusted pixel during the first through fifteenth sub-frames SF1, . . . , SF15 (e.g., during a time period of about 264.0 ms). The white conductive particles 1112*b* in the second adjusted pixel may not move, may be maintained at an initial state, and may be disposed adjacent the common electrode. Thus, the second adjusted pixel may have the sixteenth gray level G15.

In still another exemplary embodiment of the inventive concept, the second voltage V2 is applied to a third adjusted pixel electrode of a third adjusted pixel during the first through x-th sub-frame SF1, . . . , SFx, and the common voltage VCOM is applied to the third adjusted pixel electrode during (x+1)-th through fifteenth sub-frames SF(x+1), . . . , SF15, where x is a natural number>=one and <=fourteen. The white conductive particles 1112*b* in the third adjusted pixel may move toward the third adjusted pixel electrode by a distance corresponding to an applying time of the second voltage V2 in the third adjusted pixel. In this example, the third adjusted pixel may have a target gray level that corresponds to a sum of a sub-frame period of the first sub-frame SF1 through a sub-frame period of the x-th sub-frame SFx. For example, if x is two, the second voltage V2 is applied to the third adjusted pixel electrode during the first through second sub-frame SF1 and SF2, and the common voltage VCOM is applied to the third adjusted pixel electrode during third through fifteenth sub-frames SF3, . . . , SF15. Thus, the third adjusted pixel may have a fourteenth gray level G13 that corresponds to a sum of first and second sub-frame periods (e.g., a time period of about 16.8 ms).

In an exemplary embodiment of the inventive concept, a reflectance of the third adjusted pixel may decrease as x increases. If x increases, the applying time of the second voltage V2 in the third adjusted pixel may increase, the white conductive particles 1112*b* may be closer to the third adjusted pixel electrode, and the third adjusted pixel may have a darker gray level. Thus, the reflectance of the third adjusted pixel may decrease.

In an exemplary embodiment of the inventive concept, at least one of the sub-frame periods of the sub-frames SF1, . . . , SF15 may be changed based on a sub-frame control signal SFCS and period information stored in a look-up table (e.g., the look-up table 1222 in FIG. 2), and thus the gray level of each unit pixel may be effectively controlled. For example, the fourteenth gray level G13 may be changed to a lighter value by decreasing the sub-frame periods of the first and second sub-frames SF1 and SF2 (e.g., by increasing the sub-frame frequencies of the first and second sub-frames SF1 and SF2). The fourteenth gray level G13 may be changed to a darker value by increasing the sub-frame periods of the first and second sub-frames SF1 and SF2.

If an adjusted pixel has a relatively light gray level, a gray level of the adjusted pixel may be changed by moving the conductive particles in the adjusted pixel by a relatively short distance. For example, as illustrated in FIGS. 8 and 9, the gray level of the adjusted pixel may be changed from the sixteenth gray level G15 to a fifteenth gray level G14 by moving the white conductive particles in the adjusted pixel by a distance corresponding to a time period of about 8.5 ms. However, if the adjusted pixel has a relatively dark gray level, the gray level of the adjusted pixel may be changed by moving the conductive particles in the adjusted pixel by a relatively long distance. For example, as illustrated in FIGS. 8 and 9, the gray level of the adjusted pixel may be changed from a second gray level G1 to the first gray level G0 by moving the white conductive particles in the adjusted pixel by a distance corresponding to a time period of about 50 ms. Thus, the gray level of each unit pixel may be effectively controlled by adjusting the sub-frame periods of the sub-frames to be sequentially increased.

Figure 10:
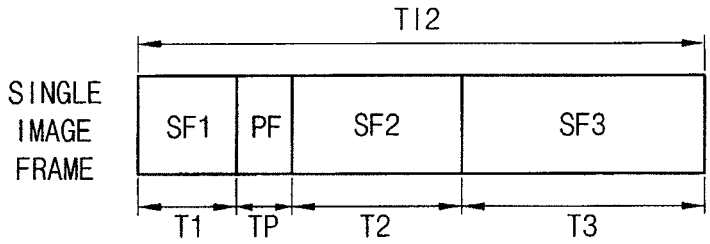
FIG. 10 is a diagram illustrating still another example of the plurality of sub-frames that may be used with the method of FIG. 1.

FIG. 10 is a diagram illustrating still another example of the plurality of sub-frames that may be with the method of FIG. 1.

Referring to FIG. 10, a plurality of sub-frames may form a single image frame, and may include a first sub-frame SF1, a second sub-frame SF2, a third sub-frame SF3 and a pause sub-frame PF disposed between the first sub-frame SF1 and the second sub-frame SF2. In comparison with the single image frame of FIG. 5, the single image frame of FIG. 10 may further include the pause sub-frame PF. The first, second and third sub-frame SF1, SF2 and SF3 in FIG. 10 may be substantially the same as the first, second and third sub-frame SF1, SF2 and SF3 in FIG. 5, respectively.

The pause sub-frame period TP of the pause sub-frame PF may be longer than or shorter than the sub-frame periods T1, T2 and T3, according to exemplary embodiments of the inventive concept. A sum of the sub-frame periods T1, T2 and T3 and the pause sub-frame period TP may be substantially the same as a frame period TI2 of the single image frame.

For convenience of illustration, a single image frame including three sub-frames and one pause sub-frame is illustrated in FIG. 10. However, the number of the sub-frames and the pause sub-frames, and the locations of the pause sub-frames in the single image frame are not limited thereto. For example, in an alternate embodiment, the pause sub-frame is located between the second and third sub-frames.

Figure 11:
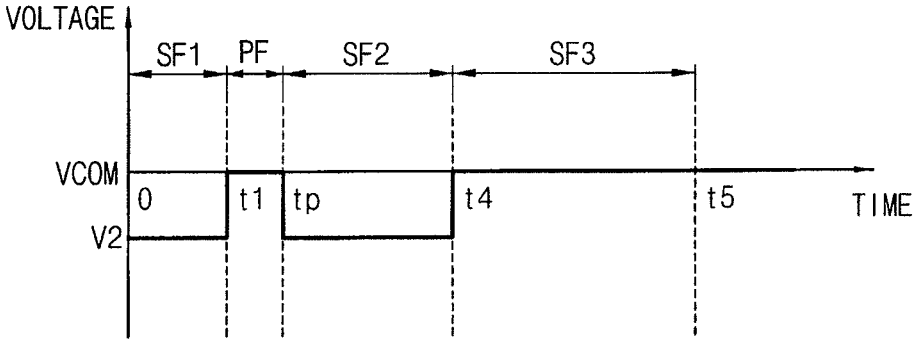
FIG. 11 is diagram for describing the method of driving the electrophoretic display device of FIG. 1.

FIG. 11 is diagram for describing a method of driving the electrophoretic display device of FIG. 1 according to an exemplary embodiment of the inventive concept. FIG. 11 illustrates the variation of a voltage applied to an adjusted pixel electrode. In comparison with the graph of FIG. 7C, a graph of FIG. 11 may further include the pause sub-frame PF. The levels of the voltages VCOM and V2, and the polarities of the conductive particles in FIG. 11 may be substantially the same as the levels of the voltages VCOM and V2, and the polarities of the conductive particles in FIG. 7C, respectively.

In FIG. 11, a first time interval from about 0 to time t1 is substantially the same as the first sub-frame period T1 in FIG. 10, a second time interval from time t1 to time tp is substantially the same as the pause sub-frame period TP in FIG. 10, a third time interval from time tp to time t4 is substantially the same as the second sub-frame period T2 in FIG. 10, and a fourth time interval from time t4 to time t5 is substantially the same as the third sub-frame period T3 in FIG. 10.

Referring to FIGS. 2, 3, 6B, and 11, during the sub-frames SF1, PF, SF2 and SF3, the common voltage VCOM is applied to the common electrode 1116*a*. The second voltage V2 is applied to the second adjusted pixel electrode during the first sub-frame SF1, the common voltage VCOM is applied to the second adjusted pixel electrode during the pause sub-frame PF, the second voltage V2 is applied to the second adjusted pixel electrode during the second sub-frame SF2, and the common voltage VCOM is applied to the second adjusted pixel electrode during the third sub-frame SF3. The second adjusted pixel may have the second gray level (e.g., dark gray color) corresponding to the second area A2 of the target image 1100*b* because an applying time of the second voltage V2 in FIG. 11 is substantially the same as the applying time of the second voltage V2 in FIG. 7C. In this example, the movements of the conductive particles included in the second adjusted pixel may be temporarily stopped during the pause sub-frame PF, and thus the gray levels of unit pixels may be effectively controlled.

Figure 12:
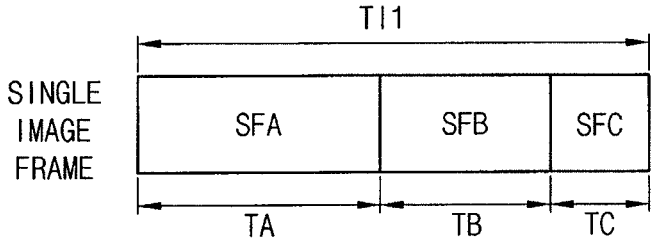
FIG. 12 is a diagram illustrating still another example of the plurality of sub-frames that may be used with the method of FIG. 1.

FIG. 12 is a diagram illustrating still another example of the plurality of sub-frames that are used with the method of FIG. 1.

Referring to FIG. 12, a plurality of sub-frames may form a single image frame, and may include a first sub-frame SFA, a second sub-frame SFB and a third sub-frame SFC. The sub-frame periods of the sub-frames SFA, SFB and SFC may sequentially decrease. For example, a second sub-frame period TB of a second sub-frame SFB may be smaller than a first sub-frame period TA of a first sub-frame SFA. A third sub-frame period TC of a third sub-frame SFC may be smaller than the second sub-frame period TB of the second sub-frame SFB. A sum of the sub-frame periods TA, TB and TC may be substantially the same as a frame period TI1 of the single image frame.

For convenience of description, it is assumed that the first sub-frame period TA in FIG. 12 is substantially the same as the third sub-frame period T3 in FIG. 5, the second sub-frame period TB in FIG. 12 is substantially the same as the second sub-frame period T2 in FIG. 5, and the third sub-frame period TC in FIG. 12 is substantially the same as the first sub-frame period T1 in FIG. 5.

FIGS. 13A, 13B, 13C, 13D and 13E are diagrams for describing a method of driving the electrophoretic display device of FIG. 1 according to an exemplary embodiment of the inventive concept. FIGS. 13A, 13B, 13C, 13D and 13E illustrate the variation of a voltage applied to an adjusted pixel electrode of an adjusted pixel.

In FIGS. 13A, 13B, 13C, 13D and 13E, a level of the first voltage V1 may be higher than a level of the common voltage VCOM, and a level of the second voltage V2 may be lower than the level of the common voltage VCOM. It is assumed that the first conductive particles 1112*b* (e.g., white conductive particles) are charged with a positive polarity, and the second conductive particles 1112*c* (e.g., black conductive particles) are charged with a negative polarity.

In an initial operation time, the sub-frame periods of the sub-frames SFA, SFB and SFC are determined. A first time interval from about 0 to time ta is substantially the same as the first sub-frame period TA in FIG. 12, a second time interval from time ta to time tb is substantially the same as the second sub-frame period TB in FIG. 12, and a third time interval from time tb to time tc is substantially the same as the third sub-frame period TC in FIG. 12.

Referring to FIGS. 2, 3, 6A and 13A, the plurality of unit pixels 1110 are initialized during a first image frame including three sub-frames SFA, SFB and SFC. During the sub-frames SFA, SFB and SFC, the common voltage VCOM is applied to the common electrode 1116*a*, and the first voltage V1 is applied to the plurality of pixel electrodes 1114*a*. The white conductive particles 1112*b* are disposed adjacent the common electrode 1116*a*, and the black conductive particles 1112*c* are disposed adjacent each pixel electrode 1114*a*, and thus all of the unit pixels 1110 have the fourth gray level (e.g., white color). The electrophoretic display panel 1100 displays the initial image 1100*a*.

Referring to FIGS. 2, 3, 6B, 13B, 13C, 13D and 13E, during a second image frame after the first image frame, the gray levels of the unit pixels 1110 are controlled by selectively applying one of the common voltage VCOM and the second voltage V2 to each pixel electrode 1114*a* during each of the sub-frames SFA, SFB and SFC.

Figure 13A:
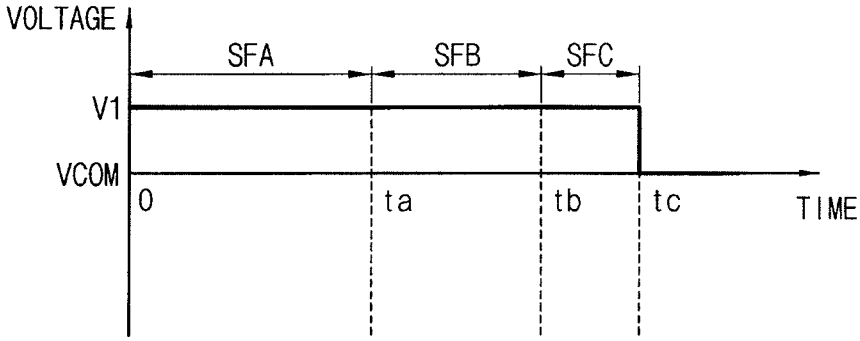
FIGS. 13A, 13B, 13C, 13D and 13E are diagrams for describing the method of driving the electrophoretic display device of FIG. 1.
Figure 13B:
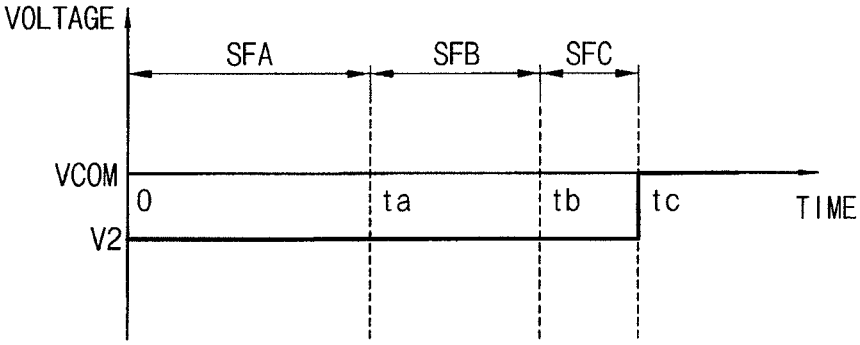

As illustrated in FIG. 13B, during the sub-frames SFA, SFB and SFC, the common voltage VCOM is applied to the common electrode 1116*a*, and the second voltage V2 is applied to a first adjusted pixel electrode included in a first adjusted pixel that corresponds to the first area A1 of the target image 1100*b*. The white conductive particles 1112*b* are disposed adjacent the first adjusted pixel electrode, the black conductive particles 1112*c* are disposed adjacent the common electrode 1116*a*, and thus the first adjusted pixel has the first gray level (e.g., dark color).

Figure 13C:
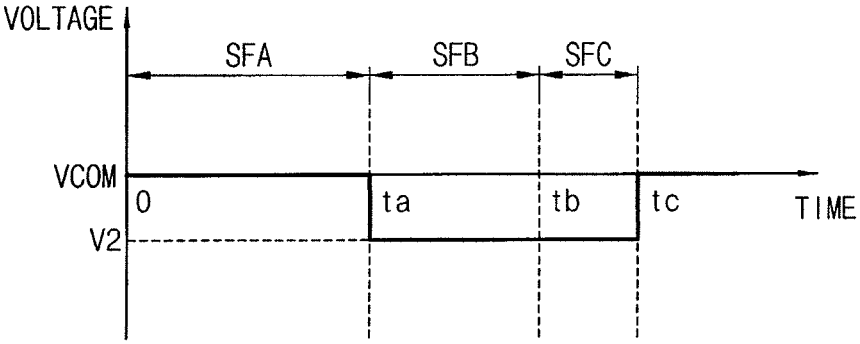

As illustrated in FIG. 13C, during the sub-frames SFA, SFB and SFC, the common voltage VCOM is applied to the common electrode 1116*a*. A second adjusted pixel electrode included in a second adjusted pixel that corresponds to the second area A2 of the target image 1100*b* sequentially receives the common voltage VCOM and the second voltage V2. For example, the common voltage VCOM is applied to the second adjusted pixel electrode during the first sub-frame SFA, and the second voltage V2 is applied to the second adjusted pixel electrode during the second and third sub-frames SFB and SFC. As described above with reference to FIG. 7C, the white conductive particles 1112*b* are disposed at the first position in the electrophoretic element 1112, and the black conductive particles 1112*c* are disposed at the second position in the electrophoretic element 1112 because an applying time of the second voltage V2 in FIG. 13C is substantially the same as the applying time of the second voltage V2 in FIG. 7C. Thus, the second adjusted pixel has the second gray level (e.g., dark gray color).

Figure 13D:
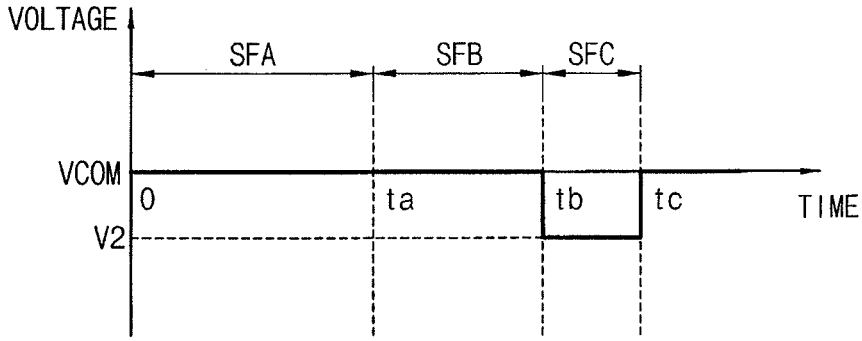

As illustrated in FIG. 13D, during the sub-frames SFA, SFB and SFC, the common voltage VCOM is applied to the common electrode 1116*a*. A third adjusted pixel electrode included in a third adjusted pixel that corresponds to the third area A3 of the target image 1100*b* sequentially receives the common voltage VCOM and the second voltage V2. For example, the common voltage VCOM is applied to the third adjusted pixel electrode during the first and second sub-frame SFA and SFB, and the second voltage V2 is applied to the third adjusted pixel electrode during the third sub-frame SFC. As described above with reference to FIG. 7D, the white conductive particles 1112*b* are disposed at the third position in the electrophoretic element 1112, and the black conductive particles 1112*c* are disposed at the fourth position in the electrophoretic element 1112 because an applying time of the second voltage V2 in FIG. 13D is substantially the same as the applying time of the second voltage V2 in FIG. 7D. Thus, the third adjusted pixel has the third gray level (e.g., light gray color).

Figure 13E:
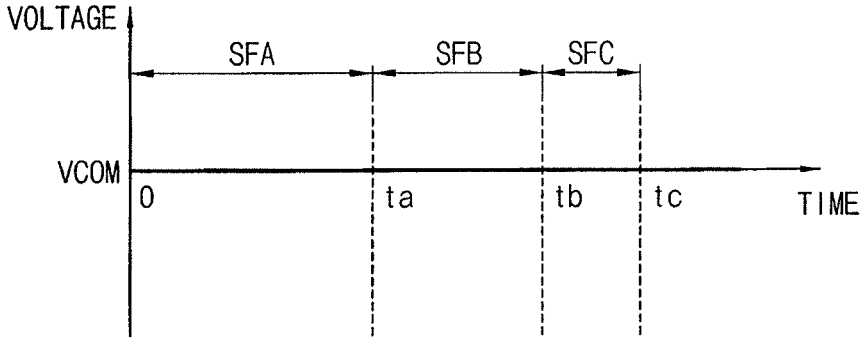

As illustrated in FIG. 13E, during the sub-frames SFA, SFB and SFC, the common voltage VCOM is applied to the common electrode 1116*a* and a fourth adjusted pixel electrode included in a fourth adjusted pixel that corresponds to the fourth area A4 of the target image 1100*b*. The white conductive particles 1112*b* are disposed adjacent the common electrode 1116*a*, the black conductive particles 1112*c* are disposed adjacent the fourth adjusted pixel electrode, and thus the gray level of the fourth adjusted pixel is maintained at the fourth gray level.

During the second image frame, the gray levels of the first, second and third adjusted pixels are changed to the first, second and third gray levels, respectively. The gray level of the fourth adjusted pixel is maintained at the fourth gray level. Thus, the electrophoretic display panel 1100 displays the target image 1100*b*. After the second image frame, the common voltage VCOM may be applied to the common electrode 1116*a* and the plurality of pixel electrodes 1114*a*, and thus the controlled gray levels of the plurality of unit pixels 1110 may be maintained.

Figure 15:
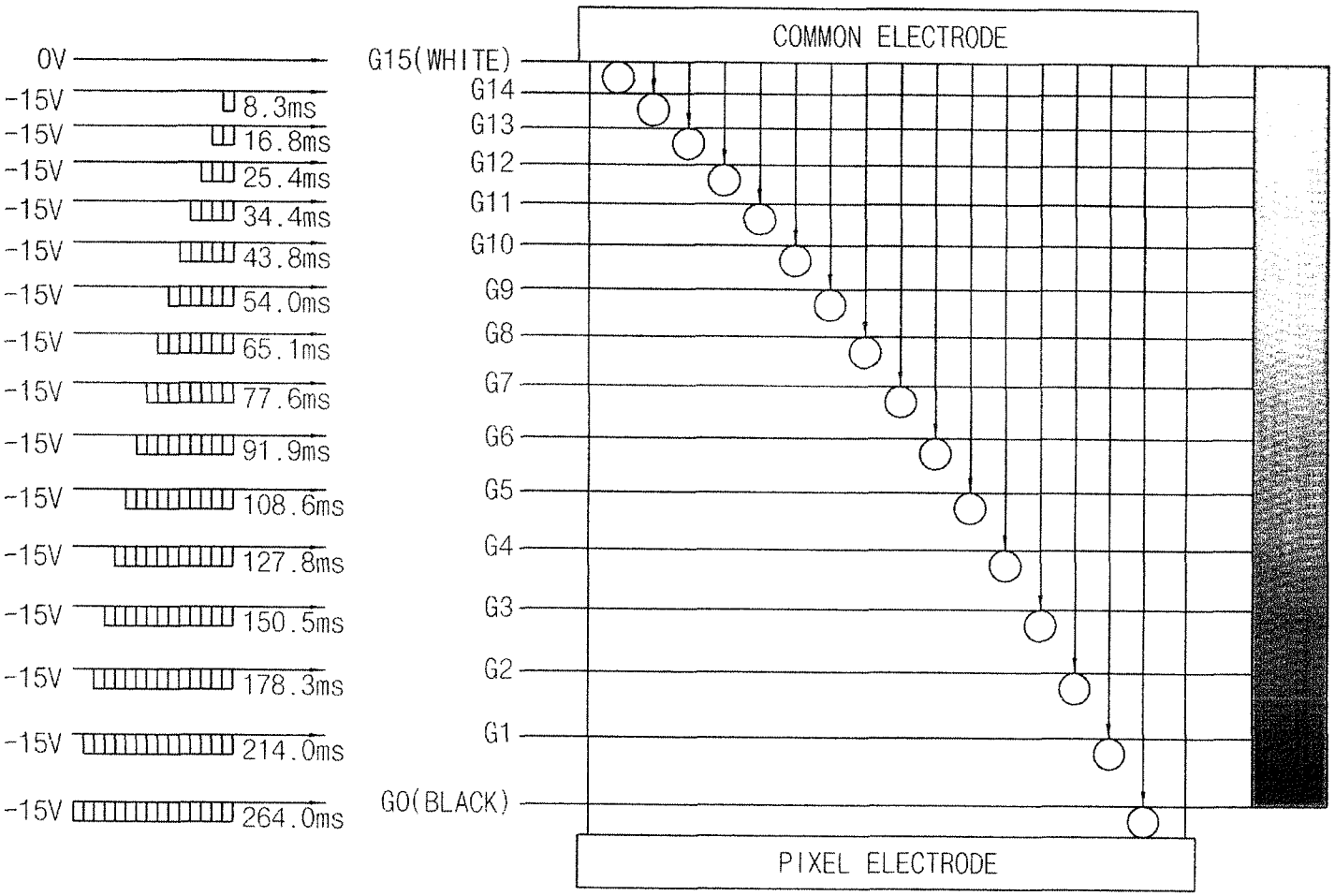
FIG. 15 is a diagram for describing the method of driving the electrophoretic display device of FIG. 1.

FIG. 14 is a table illustrating still another example of the plurality of sub-frames that may be used with the method of FIG. 1. FIG. 15 is a diagram for describing a method of driving the electrophoretic display device of FIG. 1. For convenience of illustration, only white conductive particles with the positive polarity are illustrated in FIG. 15.

Referring to FIGS. 14 and 15, a single image frame may include first through fifteenth sub-frames SFA, . . . , SFO. The sub-frame periods of the sub-frames SFA, . . . , SFO may sequentially decrease. The sub-frame frequencies of the sub-frames SFA, . . . , SFO may sequentially increase. A sub-frame period of the first sub-frame SFA in FIG. 14 may be substantially the same as the sub-frame period of the fifteenth sub-frame SF15 in FIG. 8, and a sub-frame period of the fifteenth sub-frame SFO in FIG. 14 may be substantially the same as the sub-frame period of the first sub-frame SF1 in FIG. 8. Each unit pixel 1110 may have one of first through sixteenth gray levels G0, . . . , G15. The first gray level G0 may correspond to a darkest gray level, and the sixteenth gray level G15 may correspond to a lightest gray level.

In comparison with the embodiment of FIG. 9, the adjusted pixel electrode sequentially receives the common voltage VCOM and the second voltage V2 in the embodiment described with respect to FIG. 15. For example, the common voltage VCOM may be applied to the adjusted pixel electrode of the adjusted pixel during the first through x-th sub-frame SFA, . . . SFx, and the second voltage V2 may be applied to the adjusted pixel electrode during (x+1)-th through fifteenth sub-frames SF(x+1), . . . , SFO, where x is a natural number equal to or greater than one and equal to or less than fourteen. In this example, the adjusted pixel may have a target gray level that corresponds to a sum of a sub-frame period of the (x+1)-th sub-frame SF1 through a sub-frame period of the fifteenth sub-frame SFx. For example, if x is two, the common voltage VCOM is applied to the adjusted pixel electrode during the first through second sub-frame SFA and SFB, and the second voltage V2 is applied to the adjusted pixel electrode during third through fifteenth sub-frames SFC, . . . , SFO. Thus, the adjusted pixel may have a third gray level G2 that corresponds to a sum of third through fifteenth sub-frame periods (e.g., a time period of about 178.3 ms).

FIGS. 16A, 16B, 16C, 16D and 16E are diagrams for describing a method of driving the electrophoretic display device of FIG. 1 according to an exemplary embodiment of the inventive concept. FIGS. 16A, 16B, 16C, 16D and 16E illustrate the variation of a voltage applied to an adjusted pixel electrode of an adjusted pixel.

In FIGS. 16A, 16B, 16C, 16D and 16E, a level of the first voltage V1 may be higher than a level of the common voltage VCOM, and a level of the second voltage V2 may be lower than the level of the common voltage VCOM. It is assumed that the first conductive particles 1112*b* (i.e., white conductive particles) are charged with a negative polarity, and the second conductive particles 1112*c* (i.e., black conductive particles) are charged with a positive polarity. The sub-frame periods of the sub-frames SFA, SFB and SFC are determined in an initial operation time.

Figure 16A:
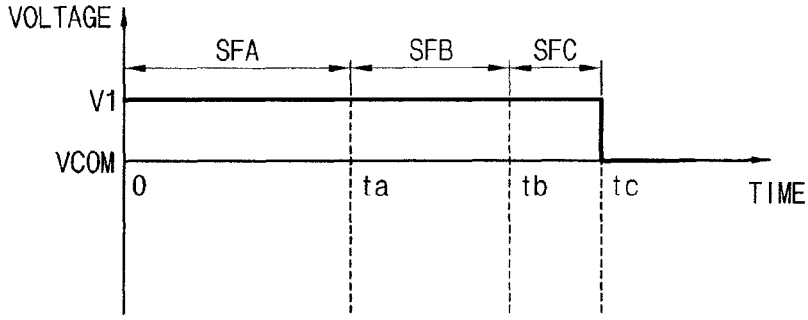
FIGS. 16A, 16B, 16C, 16D and 16E are diagrams for describing the method of driving the electrophoretic display device of FIG. 1.

Referring to FIGS. 2, 3 and 16A, the plurality of unit pixels 1110 are initialized during a first image frame. During the sub-frames SFA, SFB and SFC included in the first image frame, the common voltage VCOM is applied to the common electrode 1116*a*, and the first voltage V1 is applied to the plurality of pixel electrodes 1114*a*. The white conductive particles 1112*b* move toward each pixel electrode 1114*a* to be disposed adjacent each pixel electrode 1114*a*, and the black conductive particles 1112*c* move toward the common electrode 1116*a* to be disposed adjacent the common electrode 1116*a* because the level of the first voltage V1 is higher than the level of the common voltage VCOM. Thus, all of the unit pixels 1110 have the first gray level (e.g., black color), and the electrophoretic display panel 1100 displays an initial image having the first gray level.

Referring to FIGS. 2, 3, 6B, 16B, 16C, 16D and 16E, during a second image frame after the first image frame, the gray levels of the unit pixels 1110 are controlled by selectively applying one of the common voltage VCOM and the second voltage V2 to each pixel electrode 1114*a* during each of the sub-frames SFA, SFB and SFC.

Figure 16B:
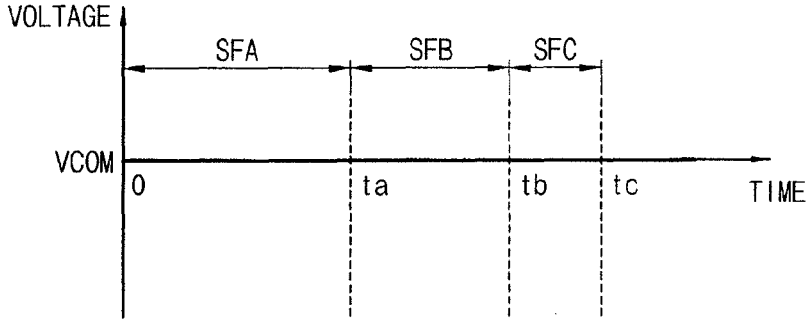

As illustrated in FIG. 16B, during the sub-frames SFA, SFB and SFC, the common voltage VCOM is applied to the common electrode 1116*a* and a first adjusted pixel electrode included in a first adjusted pixel that corresponds to the first area A1 of the target image 1100*b*. The conductive particles 1112*b* and 1112*c* in the first adjusted pixel do not move because a voltage difference between the common electrode 1116*a* and the first adjusted pixel electrode is substantially about zero. Thus, the gray level of the first adjusted pixel is maintained at the first gray level.

Figure 16C:
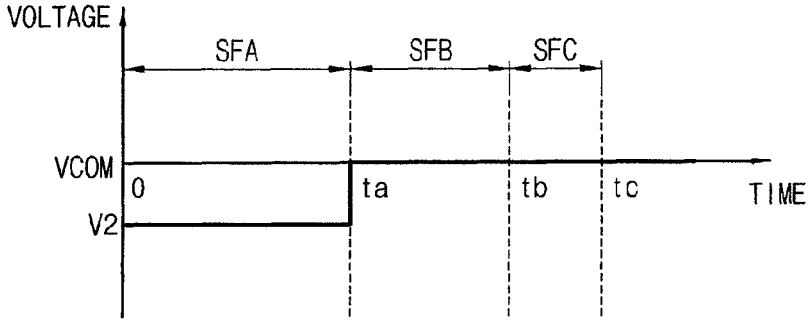

As illustrated in FIG. 16C, during the sub-frames SFA, SFB and SFC, the common voltage VCOM is applied to the common electrode 1116*a*. A second adjusted pixel electrode included in a second adjusted pixel that corresponds to the second area A2 of the target image 1100*b* sequentially receives the second voltage V2 and the common voltage VCOM. For example, the second voltage V2 is applied to the second adjusted pixel electrode during the first sub-frame SFA, and the common voltage VCOM is applied to the second adjusted pixel electrode during the second and third sub-frames SFB and SFC. The white conductive particles 1112*b* in the second adjusted pixel move toward the common electrode 1116*a*, and the black conductive particles 1112*c* in the second adjusted pixel move toward the second adjusted pixel electrode. The white conductive particles 1112*b* are disposed at a fifth position in the electrophoretic element 1112, and the black conductive particles 1112*c* are disposed at a sixth position in the electrophoretic element 1112. The fifth position is apart from the second adjusted pixel electrode by a third distance, and the sixth position is apart from the common electrode 1116*a* by the third distance. Thus, the second adjusted pixel has the second gray level (e.g., a dark gray color).

Figure 16D:
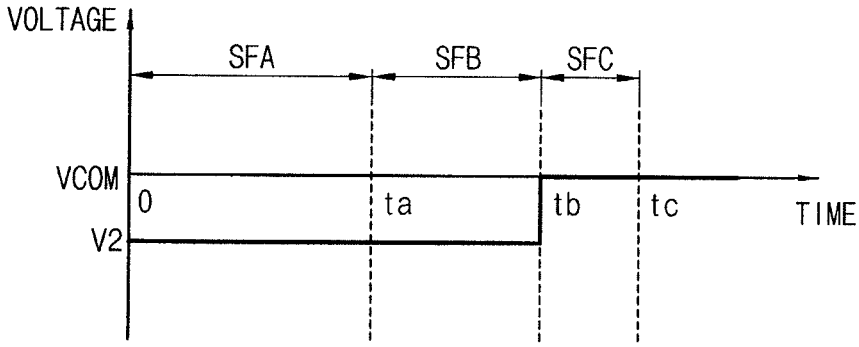

As illustrated in FIG. 16D, during the sub-frames SFA, SFB and SFC, the common voltage VCOM is applied to the common electrode 1116*a*. A third adjusted pixel electrode included in a third adjusted pixel that corresponds to the third area A3 of the target image 1100*b* sequentially receives the second voltage V2 and the common voltage VCOM. For example, the second voltage V2 is applied to the third adjusted pixel electrode during the first and second sub-frames SFA and SFB, and the common voltage VCOM is applied to the third adjusted pixel electrode during the third sub-frame SFC. The white conductive particles 1112*b* in the third adjusted pixel move toward the common electrode 1116*a*, and the black conductive particles 1112*c* in the third adjusted pixel move toward the third adjusted pixel electrode. However, moving distances of the conductive particles 1112*b* and 1112*c* in the third adjusted pixel are greater than the moving distances of the conductive particles in the second adjusted pixel because an applying time of the second voltage V2 in the third adjusted pixel is longer than the applying time of the second voltage V2 in the second adjusted pixel. The white conductive particles 1112*b* are disposed at a seventh position in the electrophoretic element 1112, and the black conductive particles 1112*c* are disposed at a eighth position in the electrophoretic element 1112. The seventh position is apart from the third adjusted pixel electrode by a fourth distance that is greater than the third distance, and the eighth position is apart from the common electrode 1116*a* by the fourth distance. Thus, the third adjusted pixel has the third gray level (e.g., light gray color).

Figure 16E:
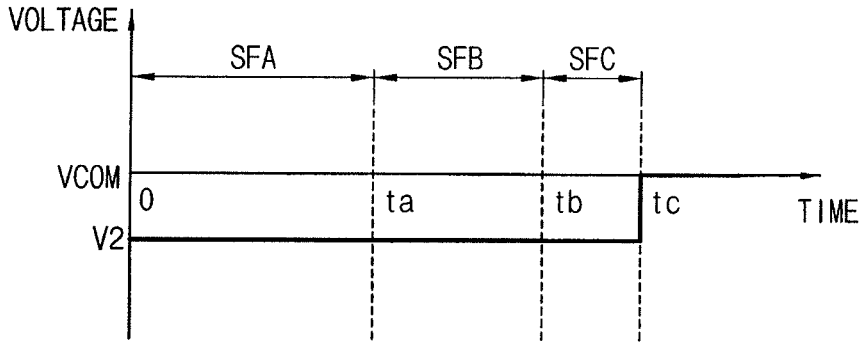

As illustrated in FIG. 16E, during the sub-frames SFA, SFB and SFC, the common voltage VCOM is applied to the common electrode 1116*a*, and the second voltage V2 is applied to a fourth adjusted pixel electrode included in a fourth adjusted pixel that corresponds to the fourth area A4 of the target image 1100*b*. The white conductive particles 1112*b* move toward the fourth adjusted pixel electrode to be disposed adjacent the fourth adjusted pixel electrode, and the black conductive particles 1112*c* move toward the common electrode 1116*a* to be disposed adjacent the common electrode 1116*a*. Thus, the fourth adjusted pixel has the fourth gray level (e.g., white color).

Figure 18:
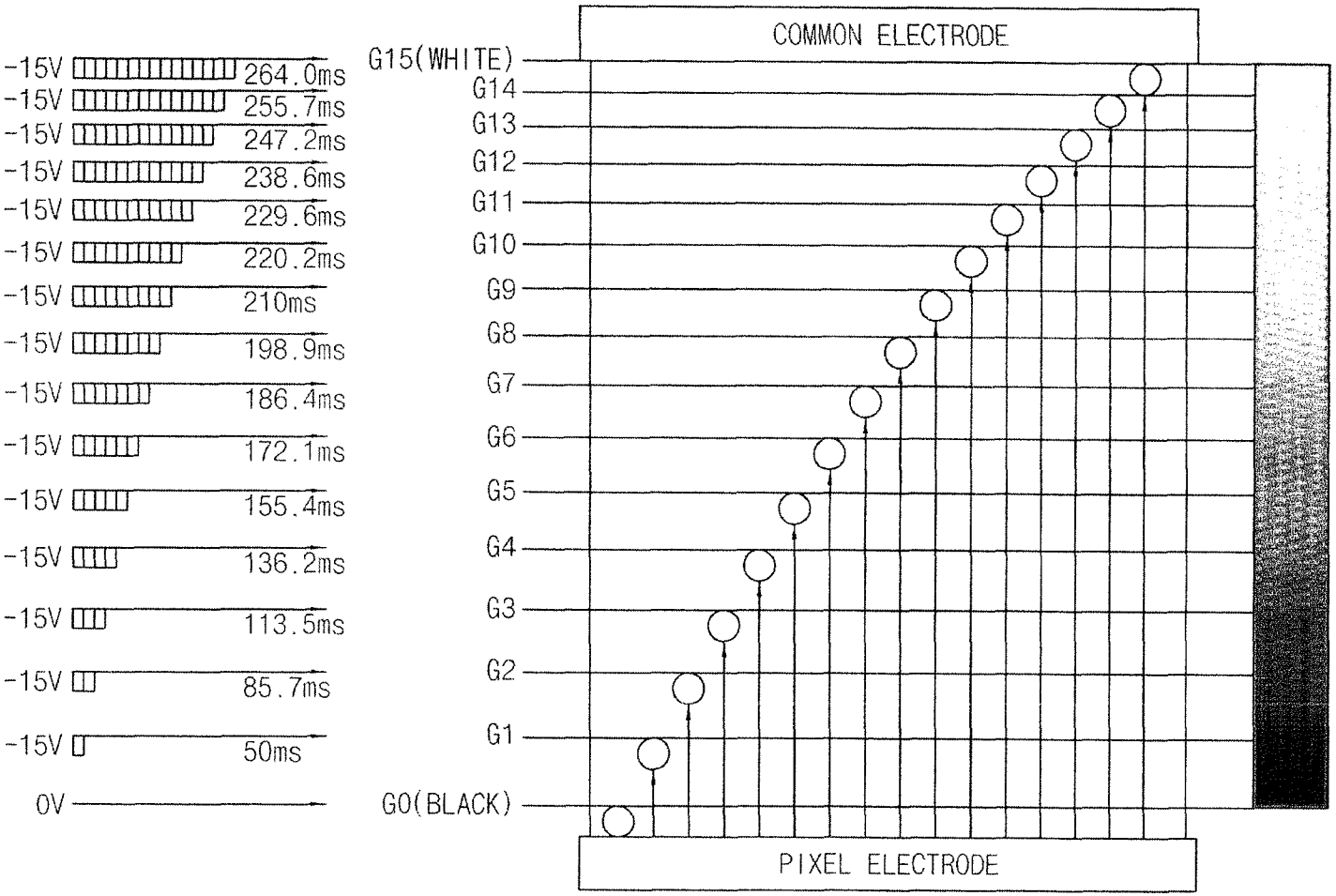
FIG. 18 is a diagram for describing the method of driving the electrophoretic display device of FIG. 1.

FIG. 17 is a table illustrating still another example of the plurality of sub-frames that may be used with the method of FIG. 1. FIG. 18 is a diagram for describing a method of driving the electrophoretic display device of FIG. 1 according to an exemplary embodiment of the inventive concept. For convenience of illustration, only white conductive particles with a negative polarity are illustrated in FIG. 18.

Referring to FIGS. 17 and 18, a single image frame may include first through fifteenth sub-frames SFA, . . . , SFO. The sub-frame periods and the sub-frame frequencies of the sub-frames SFA, . . . , SFO in FIG. 17 may be substantially the same as sub-frame periods and the sub-frame frequencies of the sub-frames SFA, . . . , SFO in FIG. 14, respectively. Each unit pixel 1110 may have one of first through sixteenth gray level G0, . . . , G15. The first gray level G0 may correspond to a darkest gray level, and the sixteenth gray level G15 may correspond to a lightest gray level.

In an exemplary embodiment of the inventive concept, the second voltage V2 (e.g., about −15V) may be applied to a first adjusted pixel electrode of a first adjusted pixel during the first through fifteenth sub-frames SFA, . . . , SFO. The white conductive particles 1112*b* in the first adjusted pixel may move toward the common electrode 1116*a*, and may be disposed adjacent the common electrode. Thus, the first adjusted pixel may have the sixteenth gray level G15. In another exemplary embodiment of the inventive concept, the common voltage VCOM (e.g., about 0V) may be applied to a second adjusted pixel electrode of a second adjusted pixel during the first through fifteenth sub-frames SFA, . . . , SFO. The white conductive particles 1112*b* in the second adjusted pixel may not move, may be maintained at an initial state, and may be disposed adjacent the second adjusted pixel electrode. Thus, the second adjusted pixel may have the first gray level G0.

In still another exemplary embodiment of the inventive concept, the second voltage V2 may be applied to a third adjusted pixel electrode of a third adjusted pixel during the first through x-th sub-frame SFA, . . . SFx, and the common voltage VCOM may be applied to the third adjusted pixel electrode during (x+1)-th through fifteenth sub-frames SF(x+1), . . . , SF15, where x is a natural number equal to or greater than one and equal to or less than fourteen. In this example, the third adjusted pixel may have a target gray level that corresponds to a sum of a sub-frame period of the first sub-frame SF1 through a sub-frame period of the x-th sub-frame SFx.

In an exemplary embodiment of the inventive concept, a reflectance of the third adjusted pixel may increase as x increases. If x increases, the applying time of the second voltage V2 in the third adjusted pixel may increase, the white conductive particles 1112*b* may be closer to the common electrode, and the third adjusted pixel may have a lighter gray level. Thus, the reflectance of the third adjusted pixel may increase.

Figure 19:
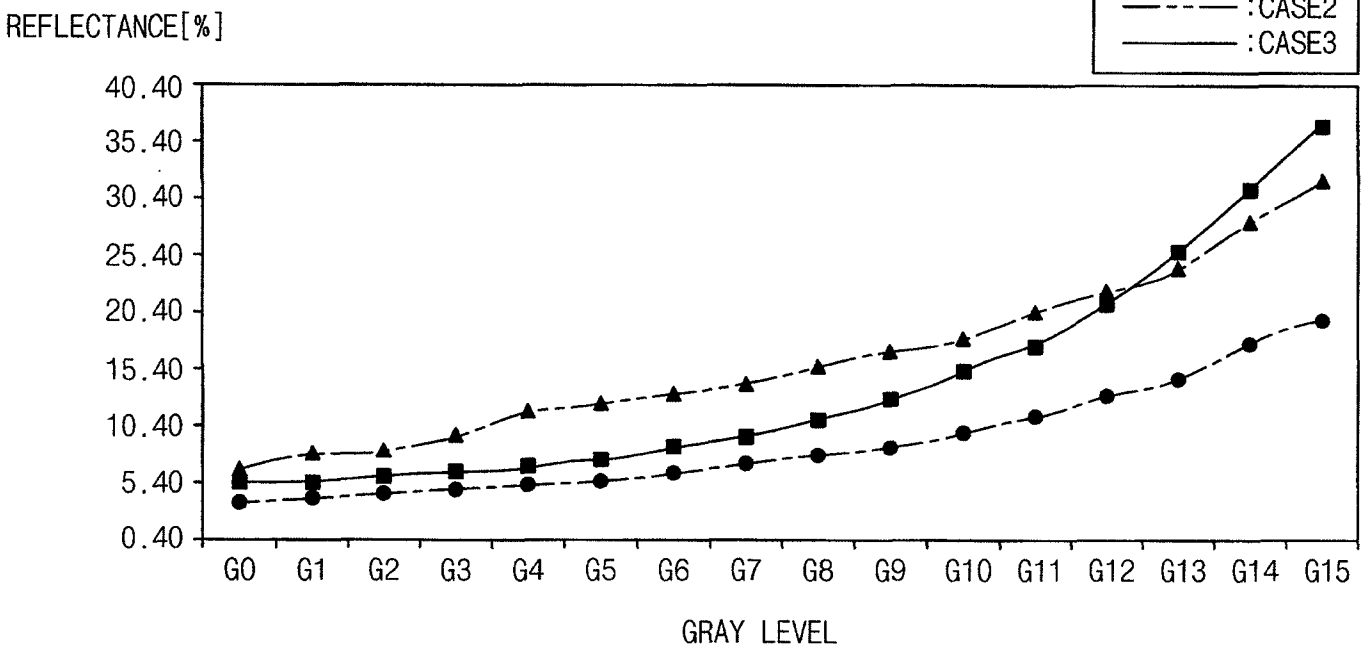
FIG. 19 is a diagram illustrating exemplary performance of the electrophoretic display device when driven by the method of FIG. 1.

FIG. 19 is a diagram illustrating exemplary performance of the electrophoretic display device when driven by the method of FIG. 1. In FIG. 19, CASE1 and CASE2 indicate reflectance of unit pixels in electrophoretic display devices driven where the sub-frame periods are the same, and CASE3 indicates reflectance of a unit pixel in the electrophoretic display device driven by the method of FIG. 1.

Referring to FIG. 19, in CASE1, a reflectance of a unit pixel having a first gray level G0 is about 3.82%, and a reflectance of a unit pixel having a sixteenth gray level G15 is about 20.41%. In CASE2, a reflectance of a unit pixel having a first gray level G0 is about 6.50%, and a reflectance of a unit pixel having a sixteenth gray level G15 is about 31.86%. In CASE3, a reflectance of a unit pixel having a first gray level G0 is about 5.36%, and a reflectance of a unit pixel having a sixteenth gray level G15 is about 36.75%. The electrophoretic display device driven by the method of FIG. 1 has a relatively great reflectance difference between the unit pixel having the first gray level G0 and the unit pixel having the sixteenth gray level G15. In addition, a reflectance graph of CASE3 has a relatively smooth curve. Thus, the electrophoretic display device driven by the method according to at least one exemplary embodiment of the inventive concept may effectively control the gray levels of unit pixels, and may display images with relatively high definition.

At least one of the above described exemplary embodiments may be applied to an electronic system having an electrophoretic display device. Thus, the present inventive concept may be applied to a system, such as a desktop computer, a laptop computer, a digital camera, a video camcorder, a cellular phone, a smart phone, a portable multimedia player (PMP), a personal digital assistant (PDA), an MP3 player, a digital television, a solid state drive (SSD), a navigation device, etc.

The foregoing is illustrative of exemplary embodiments of the inventive concept and is not to be construed as limiting thereof. Although a few exemplary embodiments have been described, many modifications are possible in these embodiments without materially departing from the present inventive concept. Accordingly, all such modifications are intended to be included within the scope of the present inventive concept.

What is claimed is:

1. A method of driving an electrophoretic display device displaying an image during an image frame divided into a plurality of sub-frames, the method comprising:

determining sub-frame periods of the plurality of sub-frames based on a predetermined resolution of the image, the plurality of sub-frames having sub-frame periods that differ from one another;

initializing a plurality of unit pixels included in the electrophoretic display device by applying a common voltage to a common electrode and by applying a first voltage to a plurality of pixel electrodes, each pixel electrode corresponding to a respective one of the plurality of unit pixels; and controlling gray levels of the plurality of unit pixels by selectively applying one of the common voltage and a second voltage to each pixel electrode during each sub-frame, wherein the plurality of sub-frames include first through n-th sub-frames, where n is a natural number>=two, and wherein a sub-frame period of a k-th sub-frame is greater than a sub-frame period of a (k−1)-th sub-frame, where k is a natural number>=two and <=n; and wherein a first unit pixel of the plurality of unit pixels has a darkest gray level when the second voltage is applied to a first pixel electrode corresponding to the first unit pixel during an entire period of the first sub-frame through the n-th sub-frame, and wherein a second unit pixel of the plurality of unit pixels has a lightest gray level when the common voltage is applied to a second pixel electrode corresponding to the second unit pixel during the entire period of the first sub-frame through the n-th sub-frame.

2. The method of claim 1, wherein a third unit pixel of the plurality of unit pixels has a target gray level when the second voltage is applied to a third pixel electrode corresponding to the third unit pixel during the first sub-frame through a m-th sub-frame and when the common voltage is applied to the third pixel electrode during a (m+1)-th sub-frame through the n-th sub-frame, where m is a natural number>=one and =(n−1), the target gray level corresponding to a sum of a sub-frame period of the first sub-frame through a sub-frame period of the m-th sub-frame.

3. The method of claim 2, wherein a reflectance of the third unit pixel decreases as m increases.

4. The method of claim 1, wherein a first unit pixel of the plurality of unit pixels has a lightest gray level when the second voltage is applied to a first pixel electrode corresponding to the first unit pixel during the first sub-frame through the n-th sub-frame, and wherein a second unit pixel of the plurality of unit pixels has a darkest gray level when the common voltage is applied to a second pixel electrode corresponding to the second unit pixel during the first sub-frame through the n-th sub-frame.

5. The method of claim 1, wherein the determining the sub-frame periods of the plurality of sub-frames includes:

determining the sub-frame periods of the plurality of sub-frames based on a sub-frame control signal and period information stored in a look-up table of the electrophoretic display device.

6. The method of claim 5, wherein the determining the sub-frame periods of the plurality of sub-frames further comprises:

inserting a pause sub-frame between a first sub-frame and a second sub-frame of the plurality of sub-frames based on the sub-frame control signal, wherein the common voltage is applied to the plurality of pixel electrodes during the pause sub-frame.

7. The method of claim 5, wherein the determining the sub-frame periods of the plurality of sub-frames further includes:

changing at least one of the sub-frame periods of the plurality of sub-frames based on the sub-frame control signal.

8. The method of claim 1, wherein the controlling the gray levels of the plurality of unit pixels includes:

selectively applying one of the common voltage and the second voltage to each of first pixel electrodes included in a first row of the plurality of unit pixels during each sub-frame based on an image signal and an image control signal; and selectively applying one of the common voltage and the second voltage to each of second pixel electrodes included in a second row of the plurality of unit pixels during each sub-frame based on the image signal and the image control signal.

9. The method of claim 1, further comprising:

maintaining the controlled gray levels of the plurality of unit pixels by applying the common voltage to the plurality of pixel electrodes after all of the sub-frame periods elapse.

10. The method of claim 1, wherein the number of the plurality of the sub-frames within an image period is the same during at least two consecutive image periods of the display device.

11. A method of driving an electrophoretic display device comprising a common electrode and a plurality of pixels, the method comprising:

applying a common voltage to the common electrode and a first voltage to pixel electrodes of the pixels during a first image period of the display device;

applying a second voltage to a pixel electrode of a first one of the pixels during an entire second image period of the display device subsequent to the first image period;

applying the second voltage to a pixel electrode of a second one of the pixels during a first part of the second image period; and applying the common voltage to the pixel electrode of the second pixel during a second part of the second image period subsequent to the first part, wherein a period of the first part differs from a period of the second part and the common voltage is in between the first and second voltages.

12. The method of claim 11, further comprising applying the common voltage to a pixel electrode of a third one of the pixels during the second image period.

13. The method of claim 12, further comprising applying the common voltage to the common electrode and to the pixel electrodes during a third image period of the device after the second image period.

14. The method of claim 11, further comprising applying the common voltage to the pixel electrode of the second pixel during a third part of the second image period that is between the first and second parts.

15. An electrophoretic display device comprising:

a display panel comprising a plurality of pixels, a common electrode receiving a common voltage, wherein each pixel includes a pixel electrode and electrophoretic elements located between the pixel electrode and the common electrode;

a gate driving unit configured to apply gate signals to gate lines of the display panel connected to the pixels during sub-frame periods of an image period of the device; and a data driving unit configured to apply one of a first voltage, a second voltage, and the common voltage to a data line of the display panel connected to a corresponding one of the pixels during the sub-frame periods, wherein the sub-frame periods differ from one another and the common voltage is between the first and second voltages, wherein the data driving unit is configured to a) apply the first voltage to all the pixel electrodes during a first image period, b) apply the second voltage to a pixel electrode of a first one of the pixels during an entire second image period, c) apply the second voltage to a pixel electrode of a second one of the pixels during a first part of the second image period, and d) apply the common voltage to the pixel electrode of the second pixel during a second part of the second image period subsequent to the first part.

16. The method of claim 11, wherein electrophoretic elements are located between the common electrode and the pixel electrodes.

* * * * *